US006642187B1

(12) United States Patent
Schwind et al.

(10) Patent No.: US 6,642,187 B1
(45) **Date of Patent: *Nov. 4, 2003**

(54) LUBRICATING COMPOSITIONS, CONCENTRATES, AND GREASES CONTAINING THE COMBINATION OF AN ORGANIC POLYSULFIDE AND AN OVERBASED COMPOSITION OR A PHOSPHORUS OR BORON COMPOUND

(75) Inventors: James J. Schwind, Derbyshire (GB); Ross L. Beebe, Mentor, OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/772,825

(22) Filed: Dec. 24, 1996

Related U.S. Application Data

(63) Continuation of application No. 08/625,786, filed on Mar. 29, 1996, now abandoned, which is a continuation of application No. 08/285,562, filed on Aug. 3, 1994, now abandoned.

(51) Int. Cl.[7] ..... C10M 141/08; C10M 135/02

(52) U.S. Cl. ..... 508/186; 508/324; 508/371; 508/391; 508/419; 508/420; 508/433; 508/440; 508/442; 508/460

(58) Field of Search ..... 508/186, 324

(56) References Cited

U.S. PATENT DOCUMENTS

| | | | | |
|---|---|---|---|---|
| 2,295,053 A | | 9/1942 | Rosen | 252/45 |
| 3,013,971 A | | 12/1961 | Mastin | 252/32.7 |
| 3,197,405 A | | 7/1965 | Le Suer | 252/32.7 |
| 3,213,020 A | | 10/1965 | Hopkins et al. | 252/32.7 |
| 3,213,021 A | | 10/1965 | Hopkins et al. | 252/32.7 |
| 3,213,022 A | | 10/1965 | Hopkins et al. | 252/32.7 |
| 3,392,201 A | | 7/1968 | Warner | 260/608 |
| 3,492,231 A | | 1/1970 | McMillen | 252/33 |
| 3,673,090 A | | 6/1972 | Waldbilig et al. | 252/45 |
| 4,119,549 A | | 10/1978 | Davis | 252/45 |
| 4,119,550 A | | 10/1978 | Davis et al. | 252/45 |
| 4,191,659 A | | 3/1980 | Davis | 252/45 |
| 4,344,854 A | | 8/1982 | Davis et al. | 252/45 |
| 4,417,990 A | | 11/1983 | Clason et al. | 252/32.7 |
| 4,564,709 A | | 1/1986 | Koyama et al. | 568/26 |
| 4,584,115 A | | 4/1986 | Davis | 252/49.6 |
| 4,670,169 A | | 6/1987 | Adams et al. | 252/46.7 |
| 4,717,490 A | | 1/1988 | Salentine | 252/32.7 |
| 4,744,920 A | | 5/1988 | Fischer et al. | 252/33.4 |
| 4,755,311 A | | 7/1988 | Burjes et al. | 252/49.9 |
| 4,792,410 A | | 12/1988 | Schwind et al. | 252/38 |
| 4,876,374 A | | 10/1989 | Adams et al. | 558/109 |
| 4,938,882 A | | 7/1990 | Tipton | 252/38 |
| 5,146,000 A | | 9/1992 | Ozbalik | 568/26 |
| 5,152,908 A | | 10/1992 | Tipton | 252/32.7 |
| 5,242,613 A | | 9/1993 | Ozbalik et al. | 252/46.7 |
| 5,250,737 A | | 10/1993 | Ozbalik | 568/21 |
| 5,264,631 A | | 11/1993 | Sandler | 568/21 |
| 5,294,743 A | | 3/1994 | Sandler | 568/26 |
| 5,403,501 A | * | 4/1995 | Schwind | 252/32.7 E |

FOREIGN PATENT DOCUMENTS

| | | |
|---|---|---|
| EP | 545653 | 11/1992 |
| EP | 604232 | 12/1993 |
| GB | 1162334 | 1/1968 |
| WO | 8705927 | 10/1987 |
| WO | 8803144 | 5/1988 |
| WO | 8804313 | 6/1988 |
| WO | 8805810 | 8/1988 |
| WO | 9109922 | 7/1991 |

OTHER PUBLICATIONS

9501150–8; Australian Search Report (Oct. 28, 1996).

* cited by examiner

*Primary Examiner*—Ellen M. McAvoy
(74) *Attorney, Agent, or Firm*—Teresan W. Gilbert; William C. Tritt; Michael F. Esposito

(57) ABSTRACT

This invention relates to a lubricating composition comprising a major amount of an oil of lubricating viscosity, (A) at least one organic polysulfide comprising at least about 90% dihydrocarbyl trisulfide, from about 0.1% up to about 8% dihydrocarbyl disulfide, and less than about 5% dihydrocarbyl higher polysulfides, and (B) at least one overbased metal composition, at least one phosphorus or boron compound, or mixtures of two or more thereof. The invention also relates to concentrates and greases containing the above combination. The invention also relates to methods of making the organic polysulfide.

30 Claims, No Drawings

LUBRICATING COMPOSITIONS, CONCENTRATES, AND GREASES CONTAINING THE COMBINATION OF AN ORGANIC POLYSULFIDE AND AN OVERBASED COMPOSITION OR A PHOSPHORUS OR BORON COMPOUND

This is a continuation of application(s) Ser. No. 08/625,786 filed on Mar. 29, 1996, now abandoned which is a continuation of application(s) Ser. No. 08/285,562 filed on Aug. 3, 1994, now abandoned.

TECHNICAL FIELD OF THE INVENTION

This invention relates to lubricating compositions, concentrates and greases containing the combination of an organic polysulfide and an overbased composition or a phosphorus or boron compound.

BACKGROUND OF THE INVENTION

Polysulfides have been used to provide extreme pressure protection to lubricating compositions. However, polysulfides may lead to copper corrosion, seal compatibility, oxidation stability, and thermal stability problems. It is desirable to find a polysulfide which when used in combination with other additives provides good extreme pressure properties to lubricants without the above adverse effects.

SUMMARY OF THE INVENTION

This invention relates to a lubricating composition comprising a major amount of an oil of lubricating viscosity, (A) at least one organic polysulfide comprising at least about 90% dihydrocarbyl trisulfide, from about 0.1% up to about 8% dihydrocarbyl disulfide, and less than about 5% dihydrocarbyl higher polysulfides, and (B) at least one overbased metal composition, at least one phosphorus or boron compound, or mixtures of two or more thereof. The invention also relates to concentrates and greases containing the above combination. The invention also relates to methods of making the organic polysulfide.

DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is hydrocarbon.

The term reflux ratio refers to the ratio of the amount of material returned to the distillation apparatus to the amount of material removed from the distillation. For instance, a reflux ratio of 5:1 means that five parts of distillate are returned to the distillation apparatus for every one part removed from the apparatus.

As described above, the present invention relates to compositions containing (A) at least one polysulfide having specific proportions of sulfides in combination with (B) at least one overbased composition, at least one phosphorus or boron compound, or mixtures thereof. In one embodiment, the organic polysulfide (A) is present at concentrations in the range of about 0.1% to about 10% by weight, or from about 0.2% up to about 8%, or from about 0.3% up to about 7%, or from about 0.5% to about 5% by weight. Here, as well as elsewhere in the specification and claims, the range and ratio limits may be combined. In one embodiment, the overbased composition, the phosphorus or boron compound, or mixture thereof (B) is present in an amount from about 0.05% up to about 10%, or from about 0.08% up to about 8%, or from about 0.1% up to about 5% by weight.

Organic Polysulfide

The organic polysulfide is a mixture comprising at least about 90% dihydrocarbyl trisulfide, from about 0.1%, or from about 0.5% up to about 8% dihydrocarbyl disulfide, and less than about 5% dihydrocarbyl higher polysulfides. Higher polysulfides are defined as containing four or more sulfide linkages. In one embodiment, the amount of trisulfide is at least about 92%, or preferably at least about 93%. In another embodiment, the amount of dihydrocarbyl higher polysulfides is less than 4%, or preferably less than about 3%. In one embodiment, the dihydrocarbyl disulfide is present in an amount from about 0.1%, or from about 0.5% up to about 5%, or preferably from about 0.6% up to about 3%.

The sulfide analysis is performed on a Varian 6000 Gas Chromatograph and FID detector SP-4100 computing integrator. The Column is a 25 m. Megabore SGE BP-1. The temperature profile is 75° C., hold 2 min., to 250° C. at 6° C./min. The helium flow is 6.0 ml/min plus make-up. The injection temperature is 200° C. and the detector temperature is 260° C. The injection size is 0.6, ul. References are the monosulfide, disulfide and trisulfide analogues to the sulfur composition for analysis. The references may be obtainied by fractionating the product to form sulfide fractions (S1, S2 and S3) to be used for analysis. The procedure for analysis is as follows. (1) An area % determination is run on each of the reference samples to determine its purity. (2) An area % determination is run on the sample to be tested to get a general idea of its composition. (3) A calibration blend is accurately weighed based on the area % results of the sample to be tested: then the internal standard toluene, is added to the blend in an amount equal to approximately one-half of the weight of the largest component. (This should give an area approximately the same as that of the largest component.) (4) The weights of each component (i.e., S-1, S-2 and S-3) are corrected by the % purity from step 1. (5) The calibration blend is run in triplicate using the corrected weights and then calculated, using the following formula, to reflect the multiple peaks in S-1 and S-2:

$$RF = \frac{\text{(concentration of components*)}}{\text{(total area of peaks)}} \frac{\text{(area of internal standard)}}{\text{(concentration of internal standard)}}$$

*Adjusted for purity of the standard i.e.: component weight times percent purity equals concentration of component.

(6) These response factors, plus the response factor for the single S-3 peak are used for determining weight percent results for the samples to be tested. (7) Results for S-1 and S-2 are adjusted to include all the peaks attributed to them. (8) Higher polysulfides are determined by difference using the following formula:

$$S\text{-}4 = 100\% - (S\text{-}1 + S\text{-}2 + S\text{-}3 + \text{light ends})$$

Light ends are defined as any peaks eluded prior to the internal standard.

The organic polysulfide generally has hydrocarbyl groups each independently having from about 2 to about 30, preferably from about two to about 20, or from about 2 to about 12 carbon atoms. The hydrocarbyl groups may be aromatic or aliphatic, preferably aliphatic. In one embodiment, the hydrocarbyl groups are alkyl groups.

The organic polysulfides may be derived from an olefin or a mercaptan. The olefins, which may be sulfurized, contain at least one olefinic double bond, which is defined as a non-aromatic double bond. Olefins having from 2 up to about 30, or from about 3 up to about 16 (most often less than about 9) carbon atoms are particularly useful. Olefins having from 2 up to about 5, or from 2 up to about 4 carbon atoms are particularly useful. Isobutylene, propylene and their dimers, trimers and tetramers, and mixtures thereof are especially preferred olefins. Of these compounds, isobutylene and diisobutylene are particularly desirable.

The mercaptans used to make the polysulfide may be hydrocarbyl mercaptans, such as those represented by the formula R—S—H, wherein R is a hydrocarbyl group as defined above. In one embodiment, R is an alkyl, an alkenyl, cycloalkyl, or cycloalkenyl group. R may also be a haloalkyl, hydroxyalkyl, or hydroxyalkyl substituted (e.g. hydroxymethyl, hydroxyethyl, etc.) aliphatic groups. R generally contains from about 2 to about 30 carbon atoms, or from about 2 to about 24, or from about 3 to about 18 carbon atoms. Examples include butyl mercaptan, amyl mercaptan, hexyl mercaptan, octyl mercaptan, 6-hydroxymethyloctanethiol, nonyl mercaptan, decyl mercaptan, 10-amino-dodecanethiol, dodecyl mercaptan, 10-hydroxymethyl-tetradecanethiol, and tetradecyl mercaptan.

In one embodiment, the organic polysulfide may be prepared by reacting, optionally under superatmospheric pressure, one or more of the above olefins with a mixture of sulfur and hydrogen sulfide in the presence, or absence, of a catalyst, such as an alkyl amine catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same. The polysulfide thus produced is fractionally distilled to form the organic polysulfide of the present invention. In one aspect, the fractional distillation occurs under subatmospheric pressure. Typically the distillation pressure is from about 1 to about 250, preferably from about 1 to about 100, or preferably from about 1 to about 25 mm Hg. A fractionation column such a Snyder fractionation column may be used. In one embodiment, the fractionation is carried out at a reflux ratio of from about 1:1 up to about 15:1, preferably from about 2:1 up to about 10:1, or preferably from about 3:1 up to about 8:1. The fraction distillation occurs at a temperature at which the sulfur composition which is being fractionated boils. Typically the fractional distillation occurs at a pot temperature from about 75° C. to about 300° C., or from about 90° C. to about 200° C.

The conditions of fractional distillation are determined by the sulfur composition being distilled. The present invention also relates to a method of making the organic polysulfide (A). The method involves fractional distillation of a sulfur composition. The method involves heating the sulfur composition to a temperature at which boiling occurs. The distillation system is brought to equilibrium and the distillation commences with a chosen reflux ratio (described above). The fractions obtained from the distillation are removed from the distillation apparatus. The amount of the desired fraction may be calculated by determining the proportion of sulfides. The desired fraction is obtained by maintaining accurate temperature control on the distillation system. The boiling fractions are removed at a specific vapor and temperature for that fraction. The reflux ratio is adjusted to maintain the temperature at which this fraction boils. After removal of the desired fraction, the fraction may be further filtered as desired.

In general, fractionation is carried out in a continuous or a batch process. In a continuous process the material to be fractionated is fed to a fractionating column. Parameters are controlled in the system such as feed flow, temperatures throughout the column, and the reflux ratio, etc., to separate the components in the feed into an overhead and bottoms stream. These parameters are adjusted to maintain the desired composition in the overhead and bottoms streams.

For a batch rocess, the material to be fractionated is charged to an agitated vessel and is heated to boiling temperatures. Once the material reaches the boiling point, the fractionation column system is brought to equilibrium. Subsequently, the desired reflux ratio is set. Collecton of the distillate is commenced, as described herein. The reflux ratio is incresed as is necessary to maintain the appropriate temperatures in the fractionating column system. As the distillation rate slows, the reflux ratio is increased until eventually the collection of the distillate stops. The different fractions are separated as the above process is repeated at higher temperatures.

The following example relates to sulfur compositions of the present invention and methods of making the same.

EXAMPLE S-1

(a) Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

(b) Charge 1000 lbs. of the product of Example S-1(a) to the reactor, under medium agitation, and heat to approximately 88° C.–94° C. Bring to equilibrium and maintain equilibrium for 30 minutes prior to collection of distillate. Set the reflux ratio at 4:1. Raise the temperature to 105° C. to ensure a steady distillation rate. Collection of the distillate will require approximately 20–24 hours and the yield will approximate 230–260 lbs. Raise the temperature to 105° C.–107° C. Bring the system to equilibrium and maintain for 30 minutes prior to collection of distillate. Set the reflux ratio at 4:1. Raise the temperature to 121° C.–124° C., in order to ensure a steady distillation rate. Collect distillate over 75–100 hours. The distillation yields approximately 300–400 lbs. of the desired product. The desired product contains 2–5% S2, 91–95% S3, 1–2% S4.

EXAMPLE S-2

In a vessel with a fractionation column, bring 10,000 grams of the product of Example S-1(a) to a boil, approximately 200° F., under medium agitation. Bring the column to equilibrium by regulating the vapor temperature. Maintain the equilibrium for 30 minutes prior to collection of distillate. Set the reflux ratio at 5:1. Under these conditions, collect the distillate until the accumulation of distillate is less than 5 ml in 15 minutes. Collect 100 ml of the distillate containing 88 grams of distillate at a vapor temperature of 56° C. Raise the temperature of the vessel 15° F. Remove an additional aliquot of 50 grams of distillate, at a vapor temperature of 58° C. Collect and remove 1838 grams of distillate, continuing collection as long as the distillate rate stays greater than 5 ml/15 minutes. If boiling drops off, raise the temperature of the vessel 5.5° C. Continue collecting distillate until the distillation rate is less than 5 ml/15 minutes is achieved. The distillate contains approximately 473 grams of desired product. For the final collection of distillate, raise the temperature of the vessel 9° C. to 116° C., not exceeding 121° C. Remove 220 ml of the distillate, containing 214 grams of distillate at a vapor temperature of 69° C. Continue collection of the remainder of the distillate, containing approximately 4114 grams of the desired product, until the distillation rate is less than 5 ml/15 minutes. A yield after fractionation should approximate 6777 grams of the desired product. The desired product contains approximately 2% S2, 95.6% S3, and 0.15% S4.

As described above the lubricating compositions, concentrates and grease additionally contain at least one overbased composition, at least one phosphorus or boron compound, or mixtures of two or more thereof.

Overbased Metal Compositions

In one embodiment, (B) is an overbased metal salt and is present in an amount from about 0.5% to about 4%, or from about 0.7% to about 3%, or from about 0.9% to about 2% by weight of the lubricating composition. Overbased metal compositions are characterized by having a metal content in excess of that which would be present according to the stoichiometry of the metal and the acidic organic compound. The amount of excess metal is commonly expressed in metal ratio. The term "metal ratio" is the ratio of the total equivalents of the metal to the equivalents of the acidic organic compound. A salt having a metal ratio of 4.5 will have 3.5 equivalents of excess metal. The overbased salts generally have a metal ratio from about 1.5 up to about 40, or from about 2 up to about 30, or from about 3 up to about 25. In one embodiment, the metal ratio is greater than about 7, or greater than about 10, or greater than about 15.

The overbased materials are prepared by reacting an acidic material, typically carbon dioxide, with a mixture comprising an acidic organic compound, a reaction medium comprising at least one inert, organic solvent for the acidic organic compound, a stoichiometric excess of a basic metal compound, and a promoter. Generally, the basic metal compounds are oxides, hydroxides, carbonates, and phosphorus acids (phosphonic or phosphoric acid) salts. The metals of the basic metal compounds are generally alkali, alkaline earth, and transition metals. Examples of the metals of the basic metal compound include sodium, potassium, lithium, magnesium, calcium, barium, titanium, manganese, cobalt, nickel, copper, and zinc, preferably sodium, potassium, calcium, and magnesium.

The acidic organic compounds useful in making the overbased compositions of the present invention include carboxylic acylating agents, sulfonic acids, phosphorus containing acids, phenols, and mixtures of two or more thereof. Preferably, the acidic organic compounds are carboxylic acylating agents, sulfonic acids, or phenates.

The carboxylic acylating agents include fatty acids, isoaliphatic acids, dimer acids, addition dicarboxylic acids, trimer acids, addition tricarboxylic acids, and hydrocarbyl substituted carboxylic acylating agents. In one embodiment, the carboxylic acylating agent is a fatty acid. Fatty acids generally contain from about 8 up to about 30, or from about 12 up to about 24 carbon atoms.

In another embodiment, the carboxylic acylating agents include isoaliphatic acids. Such acids contain a principal saturated, aliphatic chain typically having from about 14 to about 20 carbon atoms and at least one, but usually no more than about four, pendant acyclic lower (e.g. $C_{1-8}$) alkyl groups. Specific examples of such isoaliphatic acids include 10-methyl-tetradecanoic acid, 3-ethyl-hexadecanoic acid, and 8-methyl-octadecanoic acid. The isoaliphatic acids include branched-chain acids prepared by oligomerization of commercial fatty acids, such as oleic, linoleic and tall oil fatty acids.

The dimer acids include products resulting from the dimerization of unsaturated fatty acids and generally contain an average from about 18 to about 44, or from about 28 to about 40 carbon atoms. Dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference.

In another embodiment, the carboxylic acylating agents are addition carboxylic acylating agents, which are addition (4+2 and 2+2) products of an unsaturated fatty acid, such as tall oil acids and oleic acids, with one or more unsaturated carboxylic reagents, which are described below. These acids are taught in U.S. Pat. No. 2,444,328, the disclosure of which is incorporated herein by reference.

In another embodiment, the carboxylic acylating agent is a tricarboxylic acylating agent. Examples of tricarboxylic acylating agents include trimer acylating agents and the reaction product of an unsaturated carboxylic acylating agent (such as unsaturated fatty acids) and an alpha,beta-unsaturated dicarboxylic acylating agent (such as maleic, itaconic, and citraconic acylating agents, preferably maleic acylating agents). These acylating agents generally contain an average from about 18, or about 30, or about 36 to about 66, or to about 60 carbon atoms. The trimer acylating agents are prepared by the trimerization of one or more fatty acids.

In one embodiment, the tricarboxylic acylating agent is the reaction product of one or more unsaturated carboxylic acylating agent, such as an unsaturated fatty acid or unsaturated alkenyl succinic anhydride and an alpha,beta-unsaturated carboxylic reagent. The unsaturated carboxylic reagents include unsaturated carboxylic acids per se and functional derivatives thereof, such as anhydrides, esters, amides, imides, salts, acyl halides, and nitriles. The unsaturated carboxylic reagent include mono, di, tri or tetracarboxylic reagents. Specific examples of useful monobasic unsaturated carboxylic acids include acrylic acid, methacrylic acid, cinnamic acid, crotonic acid, and 2-phenylpropenoic acid. Exemplary polybasic acids include maleic acid, maleic anhydride, fumaric acid, mesaconic acid, itaconic acid and citraconic acid. Generally, the unsaturated carboxylic reagent is maleic anhydride, acid, or lower ester, e.g. those containing less than eight carbon atoms. In one embodiment, the unsaturated dicarboxylic acylating agent generally contains an average from about 12 up to about 40, or from about 18 up to about 30 carbon atoms. Examples of these tricarboxylic acylating agents include Empol® 1040 available commercially from Emery Industries, Hystrene® 5460 available commercially from Humko Chemical, and Unidyme® 60 available commercially from Union Camp Corporation.

In another embodiment, the carboxylic acylating agent is a hydrocarbyl substituted carboxylic acylating agent. The hydrocarbyl substituted carboxylic acylating agents are prepared by a reaction of one or more olefin or polyalkene with one or more of the above described unsaturated carboxylic reagents. The hydrocarbyl group generally contains from about 8 to about 300, or from about 12 up to about 200, or from about 16 up to about 150, or from about 30 to about 100 carbon atoms. In another embodiment, the hydrocarbyl group contains from about 8 up to about 40, or from about 10 up to about 30, or from about 12 up to about 24 carbon atoms. In one embodiment, the hydrocarbyl group may be derived from an olefin. The olefins typically contain from about 3 to about 40, or from about 4 to about 24 carbon atoms. These olefins are preferably alpha-olefins (sometimes referred to as mono-1-olefins or terminal olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{18-24}$ alpha-olefins, $C_{22-28}$ alpha-olefins, etc.

In another embodiment, the hydrocarbyl group is derived from a polyalkene. The polyalkene includes homopolymers and interpolymers of polymerizable olefin monomers having from 2 up to about 16, or from 2 up to about 6, or from 2 to about 4 carbon atoms. The olefins may be monoolefins, such as ethylene, propylene, 1-butene, isobutylene, and 1-octene, or polyolefinic monomers, including diolefinic monomers, such 1,3-butadiene and isoprene. The olefins also may be one or more of the above described alpha-olefins. In one embodiment, the interpolymer is a homopolymer. In one embodiment, the homopolymer is a polybutene, such as a polybutene in which about 50% of the polymer is derived from butylene. The polyalkenes are prepared by conventional procedures. In one embodiment, the polyalkene is characterized as containing from about 8 up to about 300, or from about 30 up to about 200, or from about 35 up to about 100 carbon atoms. In one embodiment, the polyalkene is characterized by a $\overline{M}n$ (number average molecular weight) of at least about 400 or at least about 500. Generally, the polyalkene is characterized by having an $\overline{M}n$ from about 500 up to about 5000, or from about 700 up to about 3000, or from about 800 up to 2500, or from about 900 up to about 2000. In another embodiment, $\overline{M}n$ varies from about 500 up to about 1500, or from about 700 up to about 1300, or from about 800 up to about 1200.

The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modem Size Exclusion Liquid Chromatographs", J. Wiley & Sons, Inc., 1979.

In another embodiment, the polyalkenes have a $\overline{M}n$ from at least about 1300, or at least about 1500, or at least about 1700. In one embodiment, the polyalkenes have a $\overline{M}n$ from about 1300 up to about 3200, or from about 1500 up to about 2800, or from about 1700 up to about 2400. In a preferred embodiment, the polyalkene has a $\overline{M}n$ from about 1700 to about 2400. The polyalkenes also generally have a $\overline{M}w/\overline{M}n$ from about 1.5 to about 4, or from about 1.8 to about 3.6, or from about 2.0 to about 3.4, or from about 2.5 to about 3.2. The hydrocarbyl substituted carboxylic acylating agents are described in U.S. Pat. Nos. 3,219,666 and 4,234,435, the disclosures of which is hereby incorporated by reference.

In another embodiment, the acylating agents may be prepared by reacting one or more of the above described polyalkenes with an excess of maleic anhydride to provide substituted succinic acylating agents wherein the number of succinic groups for each equivalent weight of substituent group, i.e., polyalkenyl group, is at least about 1.3, or at least about 1.4, or at least about 1.5. The maximum number will generally not exceed about 4.5, or about 3.5. A suitable range is from about 1.4 up to about 3.5, or from about 1.5 up to about 2.5 succinic groups per equivalent weight of substituent groups.

The carboxylic acylating agents are known in the art and have been de-scribed in detail, for example, in the following: U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); U.S. Pat. No. 4,234,435 (Meinhardt et al); and U.K. 1,440,219. The disclosures of these patents are hereby incorporated by reference for their disclosure of carboxylic acylating agents and methods for making the same.

In another embodiment, the carboxylic acylating agent is an alkylalkyleneglycol-acetic acid, or alkylpolyethyleneglycol-acetic acid. Some specific examples of these compounds include: iso-stearylpentaethyleneglycol-acetic acid; iso-stearyl-O—$(CH_2CH_2O)_5CH_2CO_2Na$; lauryl-O—$(CH2CH_2O)_{2.5}$—$CH_2CO_2H$; lauryl-O—$(CH_2CH_2O)_{3.3}CH_2CO_2H$; oleyl-O—$(CH_2C—H_2O)_4—CH_2CO_2H$; lauryl-O—$(CH_2CH_2O)_{4.5}CH_2CO_2H$; lauryl-O—$(CH_2CH_2O)—_{10}CH_2CO_2H$; lauryl-O—$(CH_2CH_2O)_{16}CH_2CO_2H$;octyl-phenyl-O—$(CH_2CH_2O)_8CH_2CO_2H$; octlyl-O—$(CH_2CH_2O)_{19}$ $CH_2CO_2H$;2-octyl-decanyl-O—$(CH_2CH_2O)_6CH_2CO_2H$. These acids are available commercially from Sandoz Che mical Co. under the tradename of Sandopan a cids.

In another embodiment, the carboxylic acylating agents are aromatic carboxylic acids. A group of useful aromatic carboxylic acids are those of the formula

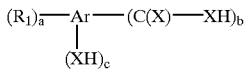

wherein $R_1$ is an aliphatic hydrocarbyl group having from about 4 to about 400 carbon atoms, a is a number in the range of zero to about 4, Ar is an aromatic group; each X is independently sulfur or oxygen, preferably oxygen, b is a number in the ran-e from one to about four, c is a number in the range of zero to about four, usually one or two, with the proviso that the sum of a, b and c does not exceed the number of valences of Ar. In one embodiment, $R_1$ and a are such that there is an average of at least about eight aliphatic carbon atoms provided by the $R_1$ groups.

The aromatic group, as represented by "Ar", as well as elsewhere in other formulae in this specification and claims, may be mononuclear or polynuclear. Examples of mononuclear Ar moieties include benzene moieties, such as 1,2,4-benzenetriyl; 1,2,3-benezenetriyl; 3-methyl-1,2,4-benzenetriyl; 2-methyl-5-ethyl-1,3,4-benzenetriyl; 3-propoxy-1,2,4,5-benzenetetrayl; 3-chloro-1,2,4-benzenetriyl; 1,2,3,5-benzenetetrayl; 3-cyclohexyl-1,2,4-benzenetriyl; and 3-azocyclopentyl-1,2,5-benzenetriyl, and pyridine moieties, such as 3,4,5-azabenzene; and 6-methyl-3,4,5-azabenzene. The polynuclear groups may be those where an aromatic nucleus is fused at two points to another aromatic nucleus, such as naphthyl and anthracenyl groups. Specific examples of fused ring aromatic moieties Ar include: 1,4,8-naphthylene; 1,5,8-naphthylene; 3,6-dimethyl-4,5,8(1-azonaphthalene); 7-methyl-9-methoxy-1,2,5,9-anthracenetetrayl; 3,10-phenathrylene; and 9-methoxy-benz(a)phenanthrene-5,6,8,12-yl. The polynuclear group may those where at least two nuclei (either mononuclear or polynuclear) are linked through bridging linkages. These bridging linkages may be chosen from the group consisting of alkylene linkages, ether linkages, keto linkages, sulfide linkages, and polysulfide linkages of 2 to about 6 sulfur atoms. Specific examples of Ar when it is linked polynuclear aromatic moiety include: 3,3',4,4',5-bisbenzenetetrayl; di(3,4-phenylene)ether; 2,3-phenylene-2,6-naphthylenemethane; and 3-methyl,9H-fluorene-1,2,4,5,8-yl; 2,2-di(3,4-phenylene)propane; sulfur-coupled 3-methyl-1,2,4-benzatriyl (having 1 to about 10 thiomethylphenylene groups); and amino-coupled 3-methyl-1,2,4-benzatriyl (having 1 to about 10 aminomethylphenylene groups). Typically Ar is a benzene nucleus, lower (e.g $C_{1-18}$) alkylene bridged benzene nucleus, or a naphthalene nucleus.

The $R_1$ group is a hydrocarbyl group that is directly bonded to the aromatic group Ar. $R_1$ typically contains from about 6 to about 80, or from about 7 to about 30, or from about 8 to about 25, or from about 8 to about 15 carbon atoms. Examples of $R_1$ groups include butyl, isobutyl, pentyl, octyl, nonyl, dodecyl, 5-chlorohexyl, 4-ethoxypentyl, 3-cyclohexyloctyl, 2,3,5-trimethylheptyl, propylene tetramer, triisobutenyl and substituents derived from one of the above described olefins or polyalkenes.

Within this group of aromatic acids, a useful class of carboxylic acids are those of the formula

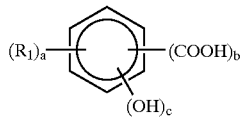

wherein $R_1$ is defined above, a is a number in the range of from zero to about 4, or from 1 to about 3; b is a number in the range of 1 to about 4, or from 1 to about 2, c is a number in the range of zero to about 4, or from 1 to about 2, and or 1; with the proviso that the sum of a, b and c does not exceed 6. In one embodiment, $R_1$ and a are such that the acid molecules contain at least an average of about 12 aliphatic carbon atoms in the aliphatic hydrocarbon substituents per acid molecule. Typically, b and c are each one and the carboxylic acid is a salicylic acid.

In one embodiment, the salicylic acids are hydrocarbyl substituted salicylic acids, wherein each hydrocarbyl substituent contains an average of at least about 8 carbon atoms per substituent and 1 to 3 substituents per molecule. In one embodiment, the hydrocarbyl substituent is derived from one or more above-described polyalkenes.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

In another embodiment, the acidic organic compound is a sulfonic acid. The sulfonic acids include sulfonic and thiosulfonic acids, preferably sulfonic acids. The sulfonic acids include the mono- or polynuclear aromatic or cycloaliphatic compounds. The oil-soluble sulfonic acids may be represented for the most part by one of the following formulae: $R_2$—T—$(SO_3)_aH$ and $R_3$—$(SO_3)_bH$, wherein T is a cyclic nucleus such as benzene, naphthalene, anthracene, diphenylene oxide, diphenylene sulfide, and petroleum naphthenes; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and one or more of the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least one.

A preferred group of sulfonic acids are mono-, di-, and tri-alkylated benzene and naphthalene sulfonic acids including their hydrogenated forms. Illustrative of synthetically produced alkylated benzene and naphthalene sulfonic acids are those containing alkyl substituents having from about 8 to about 30 carbon atoms, or from about 10 to about 30 carbon atoms, or from about 12 up to about 24 carbon atoms. Specific examples of sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and polywax-substituted sulfonic acids; alkylbenzene sulfonic acids (where the alkyl group has at least 8 carbons), dilaurylbeta-naphthyl sulfonic acids, and alkaryl sulfonic acids, such as dodecylbenzene "bottoms" sulfonic acids.

Dodecylbenzene "bottoms" sulfonic acids are the material leftover after the removal of dodecylbenzene sulfonic acids that are used for household detergents. The "bottoms" may be straight-chain or branched-chain alkylates with a straight-chain dialkylate preferred. The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

In another embodiment, the acidic organic compound is a phosphorus containing acid. The phosphorus acids include phosphoric acids, phosphonic acids, phosphinic acids, and thiophosphoric acids, including dithiophosphoric acid as well as the monothiophosphoric acid, thiophosphinic acids, and thiophosphonic acids. In one embodiment, the phosphorus containing acid is the reaction product of one or more of the above polyalkenes and a phosphorus sulfide. Useful phosphorus sulfide sources include phosphorus pentasulfide, phosphorus sesquisulfide, phosphorus heptasulfide and the like. The reaction of the polyalkene and the phos-phorus sulfide generally may occur by simply mixing the two at a temperature above 80° C., or from about 100° C. to about 300° C. Generally, the products have a phosphorus content from about 0.05% to about 10%, or from about 0.1% to about 5%. The relative proportions of the phosphorizing agent to the olefin polymer is generally from 0.1 part to 50 parts of the phosphorizing agent per 100 parts of the olefin polymer. The phosphorus containing acids are described in U.S. Pat. No. 3,232,883, issued to LeSuer. This reference is herein incorporated by reference for its disclosure to the phosphorus containing acids and methods for preparing the same.

In another embodiment, the acidic organic compound is a phenol. The phenols may be represented by the formula $(R_1)_a$—Ar—$(OH)_b$, wherein $R_1$ is defined above; Ar is an aromatic group as described above; a and b are independently numbers of at least one, the sum of a and b being in the range of two up to the number of displaceable hydrogens on the aromatic nucleus or nuclei of Ar, which is defined above. In one embodiment, a and b are each independently numbers in the range from one to about four, or from one to about two. In one embodiment, $R_1$ and a are such that there is an average of at least about eight aliphatic carbon atoms provided by the $R_1$ groups for each phenol compound.

Promoters are often used in preparing the overbased metal salts. The promoters, that is, the materials which facilitate the incorporation of the excess metal into the overbased material, are also quite diverse and well known in the art. A particularly comprehensive discussion of suitable promoters is found in U.S. Pat. Nos. 2,777,874, 2,695,910, 2,616,904, 3,384,586 and 3,492,231. These patents are incorporated by reference for their disclosure of promoters. In one embodiment, promoters include the alcoholic and phenolic promoters. The alcoholic promoters include the alkanols of one to about 12 carbon atoms, such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Acidic materials, which are reacted with the mixture of acidic organic compound, promoter, metal compound and reactive medium, are also disclosed in the above cited patents, for example, U.S. Pat. No. 2,616,904. Those disclosures are incorporated by reference for their disclosure of such acidic materials. Included within the known group of useful acidic materials are liquid acids, such as formic acid, acetic acid, nitric acid, boric acid, sulfuric acid, hydrochloric acid, hydrobromic acid, carbamic acid, substituted carbamic acids, etc. Acetic acid is a very useful acidic material although inorganic acidic compounds such as HCl, $SO_2$, $SO_3$, $CO_2$, $H_2S$, $N_2O_3$, etc., are ordinarily employed as the acidic materials. Particularly useful acidic materials are carbon dioxide and acetic acid.

The methods for preparing the overbased materials, as well as overbased materials, are known in the prior art and are disclosed, for example, in the following U.S. Pat. Nos.: 2,616,904; 2,616,905; 2,616,906; 3,242,080; 3,250,710; 3,256,186; 3,274,135; 3,492,231; and 4,230,586. These patents disclose processes, materials, which can be overbased, suitable metal bases, promoters, and acidic materials, as well as a variety of specific overbased products useful in producing the overbased systems of this invention and are, accordingly, incorporated herein by reference for these disclosures.

The temperature at which the acidic material is contacted with the remainder of the reaction mass depends to a large measure upon the promoting agent used. With a phenolic promoter, the temperature usually ranges from about 80° C. to about 300° C., and preferably from about 100° C. to about 200° C. When an alcohol or mercaptan is used as the promoting agent, the temperature usually will not exceed the reflux temperature of the reaction mixture and preferably will not exceed about 100° C.

In one embodiment, the overbased metal salts are borated overbased metal salts. The borated overbased metals salts are prepared by reacting one or more of the above overbased metals salts with one or more boron compounds. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. The boron esters are preferably lower alkyl (1–7 carbon atoms) esters of boric acid. Preferably, the boron compound is boric acid. The borated overbased metal salts generally contains from about 0.1% up to about 15%, or from about 0.5% up to about 10%, or from about 1% up to about 8% by weight boron. Borated overbased compositions, lubricating compositions containing the same and methods of preparing borated overbased compositions are found in U.S. Pat. No. 4,744,920, issued to Fischer et al; U.S. Pat. No. 4,792,410, issued to Schwind et al, and PCT Publication WO88/03144. The disclosures relating to the above are hereby incorporated by reference.

The following examples relate to overbased metal salts and borated overbased metal salts and methods of making the same. Unless the context indicates otherwise, here as well as elsewhere in the specification and claims, parts and percentages are by weight, temperature is in degrees Celsius and pressure is atmospheric pressure.

EXAMPLE O-1

(a) A mixture of 853 grams of methyl alcohol, 410 grams of blend oil, 54 grams of sodium hydroxide, and a neutralizing amount of additional sodium hydroxide is prepared. The amount of the latter addition of sodium hydroxide is dependent upon the acid number of the subsequently added sulfonic acid. The temperature of the mixture is adjusted to 49° C. A mixture (1070 grams) of straight chain dialkyl benzene sulfonic acid (molecular weight=430) and blend oil (42% by weight active content) is added while maintaining the temperature at 49–57° C. Polyisobutenyl (number average n=950)-substituted succinic anhydride (145 grams) is added to the reaction mixture. Sodium hydroxide (838 grams) is added to the reaaction mixture and the temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35% by weight.

(b) A mixture of 1000 grams of the product from Example O-1(a) above, 0.13 gram of an antifoaming agent (kerosene solution of Dow Coming 200 Fluid, and 133 grams of blend oil is heated to 74–79° C. with stirring. Boric acid (486 grams) is added to the reaction mixture. The reaction mixture is heated to 121° C. to liberate water of reaction and 40–50% by weight of the $CO_2$ contained in the product from Example O-1(a). The reaction mixture is heated to 154–160° C. and maintained at that temperature until the free and total water contents are reduced to 0.3% by weight or less and approximately 1–2% by weight, respectively. The reaction product is cooled and filtered. The filtrate has 6.1% boron, 14.4% sodium, and 35% 100 neutral mineral oil.

EXAMPLE O-2

(a) A mixture of 1000 grams of a primarily branched chain monoalkyl benzene sulfonic acid ($\overline{M}w$=500), 771 grams of o-xylene, and 75.2 grams of polyisobutenyl (number average $\overline{M}n$=950) succinic anhydride is prepared and the temperature is adjusted to 46° C. Magnesium oxide (87.3 grams), acetic acid (35.8 grams), methyl alcohol (31.4 grams), and water (59 grams) are added sequentially to the reaction vessel. The reaction mixture is blown with 77.3 grams of carbon dioxide at a temperature of 49–54° C. Additionally, 87.3 grams of magnesium oxide, 31.4 grams of methyl alcohol and 59 grams of water are added to the reaction vessel, and the reaction mixture is blown with 77.3 grams of carbon dioxide at 49–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.3% by weight, a metal ratio of 14.7, a sulfate ash content of 46.0%, and a sulfur content of 1.6% by weight.

(b) A mixture of 1000 grams of the product from Example O-2(a) and 181 grams of diluent oil is heated to 790C. Boric acid (300 grams) is added and the reaction mixture is heated to 124° C. over a period of 8 hours. The reaction mixture is maintained at 121–127° C. for 2–3 hours. A nitrogen sparge is started and the reaction mixture is heated to 149° C. to remove water until the water content is 3% by weight or less. The reaction mixture is filtered to provide the desired product. The product contains 7.63% magnesium and 4.35% boron.

EXAMPLE O-3

(a) A reaction vessel is charged with 281 parts (0.5 equivalent) of a polybutenyl-substituted succinic anhydride derived from a polybutene (n=1000), 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 SCFH and the reaction temperature is increased to 148° C. The reaction mixture is then blown with carbon dioxide at 1 SCFH for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 SCFH. The reaction temperature is increased to 140° C. where the reaction mixture is blown with carbon dioxide at 1 SCFH for 1 hour and 25 minutes while 150 parts of water is collected. The reaction temperature is decreased to 100° C. and 272 parts (3.4 equivalents) of the above sodium hydroxide solution is added while blowing the mixture with nitrogen at 1 SCFH. The reaction temperature is increased to 148° C. and the reaction mixture is blown with carbon dioxide at 1 SCFH for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth. The filtrate contains 50.0% sodium sulfate ash (theoretical 53.8%) by ASTM D-874, total base number of 408, a specific gravity of 1.18 and 37.1% oil.

(b) A reaction vessel is charged with 700 parts of the product of Example O-3(a). The reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 SCFH at 160° C. for 30 minutes while 95 parts of water is collected. Xylene (200 parts) is added to the reaction mixture and the reaction temperature is maintained at 130–140° C. for 3 hours. The reaction mixture is vacuum stripped at 150° C. and 20 millimeters of mercury. The residue is filtered through diatomaceous earth. The filtrate contains 5.84% boron (theoretical 6.43) and 33.1% oil. The residue has a total base number of 309.

EXAMPLE O-4

A mixture of 794.5 kg of polyisobutenyl (n=950) succinic anhydride, 994.3 kg of SC-100 Solvent (a product of Ohio Solvents identified as an aromatic hydrocarbon solvent), 858.1 kg of blend oil, 72.6 kg of propylene tetramer phenol, 154.4 kg of water, 113.5 grams of a kerosene solution of Dow Coming 200 having a viscosity 1000 cSt at 25° C., and 454 grams of caustic soda flake is prepared at room temperature. The reaction mixture is heated exothermically by 10° C. The reaction mixture is heated with stirring under reflux conditions to 137.8° C. over a period of 1.5 hours. The reaction mixture is blown with $CO_2$ at a rate of 45.4 kg per hour for 5.9 hours. Aqueous distillate (146.2 kg) is removed from the reaction mixture. The reaction mixture is cooled to 82.2° C., where 429 kg of organic distillate are added back to the reaction mixture. The reaction mixture is heated to 138° C. and 454 kg of caustic soda are added. The reaction mixture is blown with $CO_2$ at a rate of 45.4 kg per hour for 5.9 hours while maintaining the temperature at 135–141° C. The reaction mixture is heated to 149° C. and maintained at that temperature until distillation ceases. 149.4 kg of aqueous distillate and 487.6 kg of organic distillate are removed over a 5-hour period. The reaction mixture is flash stripped to 160° C. at a pressure of 70 mm Hg absolute. 32.7 kg of aqueous distillate and 500.3 kg of organic distillate are removed from the reaction mixture. 858.1 kg of blend oil are added. 68.1 kg of diatomaceous earth filter aid are added to the reaction mixture. The reaction mixture is filtered to provide the desired product. The resulting product has a sulfate ash content of 38.99% by weight, a sodium content of 12.63% by weight, a $CO_2$ content of 12.0% by weight, a base number (bromophenol blue) of 320, a viscosity of 94.8 cSt at 100° C., and a specific gravity of 1.06.

In one embodiment, the overbased metal salt is a sulfite or sulfate overbased metal salt. As used in the specification and appended claims, a sulfite overbased metal salt contains a salt which is composed of a metal cation and a $SO_x$ anion, where x is a number from 2 to about 4. The salts may be sulfite, sulfate, or mixtures of sulfite and sulfate salts. The sulfite or sulfate overbased metal salts may be prepared from the above described overbased metal salts or the borated overbased metal salts. In this embodiment, the sulfite or sulfate overbased metal salts may be prepared by using a sulfurous acid, sulfurous ester, or sulfurous anhydride as the acidic material in the overbasing process described above. Examples of sulfurous acids, anhydrides, and esters include sulfurous acid, ethylsulfonic acid, sulfur dioxide, thiosulfuric acid, dithionous acid, etc. The overbased metal salts also may be prepared by using an acidic material other than a sulfurous acid, sulfurous ester, or sulfurous anhydride. When the overbased salt is prepared with acidic materials other than sulfurous acid, anhydride or esters, then the overbased salt is treated with a sulfurous acid, sulfurous anhydride, sulfurous ester, or a source thereof. This treatment displaces the acidic material with the sulfurous acid, sulfurous anhydride, or sulfurous ester. Generally an excess of sulfurous acid, ester, or anhydride is used to treat the overbased metal salts. Typically, from about 0.5 to about 1 equivalent of sulfurous acid, ester, or anhydride is reacted with each equivalent of overbased metal salts. Contacting a carbonated overbased or a borated carbonated overbased metal salt with a sulfurous acid or anhydride is preferred. The contacting is accomplished by techniques known to those in the art.

In one embodiment, the carbonated overbased metal salts are treated with sulfur dioxide ($SO_2$). Generally an excess of sulfur dioxide is used. The contacting of the metal salt is continued until a desired amount of the acidic material is displaced by the sulfurous acid, anhydride, or ester, e.g. $SO_2$. Generally, it is preferred to effect a complete or substantially complete displacement of the acidic material. The displacement of acidic material may conveniently be followed by infrared spectral, sulfur, or total base number analysis. When the acidic material is carbon dioxide, the decrease in the carbonate peak (885 $cm^{-1}$) shows the displacement of the carbon dioxide. The sulfite peak appears as a broad peak at 971 $cm^{-1}$The sulfate peak occur as a broad peak at 1111 $cm^{-1}$. The temperature of the reaction can be from about room temperature up to the decomposition temperature of the reactants or desired product. Generally, the temperature is in the range of about 70° C. up to about 250° C., preferably from about 100° C. to about 200° C.

In one embodiment, a sulfite overbased metal salt is further reacted with an oxidizing agent to form a sulfate overbased metal salt. The oxidizing materials include oxygen and peroxides, such as hydrogen peroxides and organic peroxides (e.g. $C_{1-8}$peroxides). In another embodiment, the sulfite or sulfate overbased metal salt is prepared by reacting one or more of the above overbased metal salts, including the borated overbased metal salts with sulfuric acid.

The following Examples O-5 to O-10 are provided to illustrate procedures for displacing acidic material from the overbased product with $SO_2$ or a source of $SO_2$.

EXAMPLE O-5

The product of Example O-1(a) (1610 grams, 12.6 equivalents) is blown with 403 grams (12.6 equivalents) of $SO_2$ over an eight hour period at a temperature of 135–155° C. and a flow rate of 0.52 cfh. The $CO_2$ level in the resulting product is 1.47% by weight. The total base number (bromophenol blue) is 218. The sulfur content is 12.1% by weight and the sodium content is 17.6% by weight.

EXAMPLE O-6

The product of Example O-1(a) (3000 grams, 23.5 equivalents) is blown with 376 grams (11.75 equivalents) of $SO_2$ at a temperature of 140–150° C. and a flow rate of 1.4 cfh for eight hours. The resulting product is stored at room temperature for 16 hours under a nitrogen blanket and then filtered using diatomaceous earth. The product has a sulfur content of 8.2% by weight and a sodium content of 18.2% by weight.

EXAMPLE O-7

The product of Example O-6 (1750 grams, 10.0 equivalents) is blown with 320 grams (10.0 equivalents) of $SO_2$ at a temperature of 130° C. and a flow rate of 1.0 cfh for 15.5 hours. The resulting product is filtered using diatomaceous earth. The product has a sulfur content of 7.26% by weight, a sodium content of 12.6% by weight, and a boron content of 6.06% by weight.

EXAMPLE O-8

The product of Example O-5 (3480 grams, 20 equivalents) is blown with 640 grams (20 equivalents) of $SO_2$ over an 15 hour period at a temperature of 140° C. and a flow rate of 1.35 cfh. The reaction mixture is then blown with nitrogen for 0.5 hour. The mixture is filtered using diatomaceous earth to provide 3570 grams of the desired product. The sulfur content is 8.52% by weight and the sodium content is 13.25% by weight.

EXAMPLE O-9

The product of Example 0-1a (1100 grams, 4.4 equivalents, based on equivalents of sulfite) is charged to a reaction vessel and air blown for eight hours at 150° C. The vessel contents are cooled to 100° C. where 250 grams (2.2 equivalents) of a 30% solution of hydrogen peroxide is added dropwise over 1.5 hours. Distillate is removed and the mixture is heated to 135° C. Reaction is cooled to 120° C. where 250 grams (2.2 equivalents) of the above hydrogen peroxide solution is added to the mixture. The reaction temperature increases exothermically to 130° C. Infrared analysis indicates sulfate peaks (1111 $cm^{-1}$), and a decrease in sulfite peak (971 $cm^{-1}$). More hydrogen peroxide solution (25 grams, 0.2 equivalent) is added to the reaction vessel and the temperature is increased from 125° C. to 130° C. over two hours. The reaction mixture is blown with nitrogen at 157° C. to remove volatile materials. The residue is centrifuged (1600 RPM). Liquid is decanted and stripped at 155° C. with nitrogen blowing. The residue is the product. The product has 12.4% sulfur, 52.2% sulfated ash, a base number (phenolphthalein) of 11, and a base number (bromophenol blue) of 60.

EXAMPLE O-10

A reaction vessel is charged with 3700 grams (14.8 equivalents, based on sulfite) of the product of Example O-1a. The vessel contents are heated to 110° C. where 256 grams (2.3 equivalents) of a 30% hydrogen peroxide solution is added to the reaction vessel. Distillate is collected. An additional 1505 grams (13.28 equivalents) of 30% hydrogen peroxide solution is added to the reaction vessel over two hours. Water is removed by nitrogen blowing and the reaction temperature increases from 110° C. to 157° C. over two hours. The product is diluted with toluene and filtered through diatomaceous earth. The filtrate is transferred to a stripping vessel and blown with nitrogen at 1.5 standard cubic feet per hour at 150° C. The residue is the desired product. The product has 16.3% sodium, 11.9% sulfur, a base number (phenolphthalein) of 5.8, and a base number (bromophenol blue) of 39.

In one embodiment, the overbased metal salt is a sulfurized overbased composition. The acidic material used in the preparation of the overbased metal salt is $SO_2$ or a source of $SO_2$. The overbased metal salt is further reacted using the sulfur or sulfur source. The sulfur sources include elemental sulfur and any of the sulfur compounds described herein. In another embodiment, the acidic material is other than $SO_2$ or a source of $SO_2$ (that is, the acidic material is $CO_2$, carbamic acid, acetic acid, formic acid, boric acid, trinitromethane, etc.), and in this embodiment the overbased metal salt is contacted with an effective amount of $SO_2$ or a source of $SO_2$ for an period of time to displace at least part of the acidic material from the overbased metal salt prior to or during sulfurization with the sulfur or sulfur source.

The contacting of the overbased metal salt with the $SO_2$ or source of $SO_2$ is preferably affected using standard gas/liquid contacting techniques (e.g., blowing, sparging, etc.). In one embodiment, $SO_2$ flow rates from about 0.1 to about 100 cfh, preferably from about 0.1 to about 20 cfh, more preferably from about 0.1 to about 10 cfh, more preferably from about 0.1 to about 5 cfh, can be used. Contacting of the overbased metal salt with the $SO_2$ or source of $SO_2$ is continued until a desired amount of the acidic material has been displaced by the $SO_2$ or source of $SO_2$. Generally, it is preferred to effect a complete or substantially complete displacement of the acidic material with the $SO_2$ or source of $SO_2$. However the weight ratio of nondisplaced acidic material to displaced acidic material can range up to about 20:1, and in some instances can be from about 20:1 to about 1:20, and often from about 1:1 to about 1:20. Techniques known to those skilled in the art such as infrared spectral analysis, base number measurement, etc., can be used to determine the progress of the reaction and the desired end point. The sources of $SO_2$ are described above and include the oxo acids of sulfur. The temperature of the reaction can be from room temperature up to the decomposition temperature of the reactants or the reaction products, and is preferably in the range from about 70° C. to about 250° C., or from about 100° C. to about 200° C., or from about 120° C. to about 170° C. The time of the reaction is dependent upon the desired extent of displacement. The reaction can be conducted over a period of about 0.1 to about 50 hours, and often is conducted over a period of about 3 to about 18 hours.

As indicated above, displacement of the acidic material with the $SO_2$ or source of $SO_2$ can be effected prior to or during the sulfurization of the overbased metal salt with the sulfur or sulfur source. When displacement of the acidic material with the $SO_2$ or source of $SO_2$ is effected simultaneously with the sulfurization of the overbased product with the sulfur or sulfur source, unexpected rapid rates of formation of desired thiosulfate products have been observed.

The sulfurized overbased compositions are made by contacting the overbased metal salt with the sulfur or sulfur source for an effective period of time and at a sufficient temperature to form the desired sulfurized product. As indicated above, it is believed that the sulfurized product is at least in part a thiosulfate. The contacting can be effective by mixing the sulfur or sulfur source with the overbased product using standard mixing or blending techniques. The contact time is typically from about 0.1 to about 200 hours, preferably about 1 to about 100 hours, more preferably about 5 to about 50 hours, and in many instances from about 10 to about 30 hours. The temperature is generally from about room temperature up to the decomposition temperature of the reactants or desired products having the lowest such temperature, preferably from about 20° C. to about 300° C., more preferably about 20° C. to about 200° C., more preferably about 20° C. to about 150° C. Typically, the ratio of equivalents of sulfur or sulfur source per equivalent of overbased product is from about 0.1 to about 10, preferably about 0.3 to about 5, more preferably about 0.5 to about 1.5. In one embodiment the ratio is about 0.65 to about 1.2 equivalents of sulfur or sulfur source per equivalent of overbased product.

For purposes of this reaction, an equivalent of the sulfur or sulfur source is based upon the number of moles of sulfur available to react with the $SO_2$ in the overbased metal salt. Thus, for example, elemental sulfur has an equivalent weight equal to its atomic weight. An equivalent of the overbased metal salt is based upon the number of moles of $SO_2$ in the overbased metal salt available to react with the sulfur. Thus, an overbased metal salt containing one mole of $SO_2$ has an equivalent weight equal to its actual weight. An overbased metal salt containing two moles of $SO_2$ has an equivalent weight equal to one half its actual weight.

While not wishing to be bound by theory, it is believed that the product that is formed using $SO_2$ or a source of $SO_2$ as the acidic material or is formed using $SO_2$ or a source of $SO_2$ to displace the acidic material is a mixture of a number of products but includes, at least in part, a sulfite, and the product that is formed as a result of the sulfurization with the sulfur or sulfur source is also a mixture of a number of products but includes, at least in part, a thiosulfate. Thus, for example, if the overbased metal salt is a sodium sulfonate made using $CO_2$ as the acidic material, it can be represented by the formula, $RSO_3Na(Na_2CO_3)_x$ (Overbased Sodium Sulfonate), the sulfite formed by contacting this sodium sulfonate with the $SO_2$ or source of $SO_2$ can be represented by the formula, $RSO_3Na(Na_2SO_3)_x$ (Sulfite), and the thiosulfate formed by the sulfurization of this sulfite with the sulfur or sulfur source can be represented by the formula $RSO_3Na(Na_2S_2O_3)_x$ (Thiosulfate), wherein in each formula x is a number that is generally one or higher. The progress of both of these reactions can be measured using infrared or base number analysis. One technique for quantitatively measuring the sulfite and thiosulfate content of the inventive sulfurized overbased products is through the use of differential pulse polarography which is a known analytical technique involving measuring current vs. potential applied to a sample within an electrolytic cell.

The following Examples O-11 through O-16 are illustrative of the preparation of the sulfurized overbased products.

EXAMPLE O-11

A mixture of 1400 grams (5.5 equivalents) of a first sulfite derived from the product of Example O-1(a) and $SO_2$ having a sulfur content of 12.6% by weight and a sodium content of 17.6% by weight, 300 grams (1.0 equivalent) of a second sulfite derived from the product of Example O-1(a) and $SO_2$ having a sulfur content 10.7% by weight and a sodium content of 16.2% by weight, and 208 grams (6.5 equivalents) of sulfur are heated to a temperature of 140° C. and maintained at that temperature with stirring for 22 hours to provide 1535 grams of the desired product which is in the form of a brown oil. The product has a sulfur content of 22% by weight and a sodium content of 16.9% by weight.

EXAMPLE O-12

A mixture of 1172 grams (4 equivalents) of the product from Example O-5 and 64 grams (2 equivalents) of sulfur are heated to a temperature of 140–150° C. and maintained at that temperature with stirring for 21 hours to provide 1121 grams of the desired product which is in the form of a brown oil. The product has a sulfur content of 15.7% by weight and a sodium content of 17.2% by weight.

EXAMPLE O-13

A mixture of 880 grams (2 equivalents) of the product from Example O-9 and 77 grams (2.4 equivalents) of sulfur are heated to a temperature of 130° C. and maintained at that temperature with stirring for 17.5 hour. 100 grams of diluent oil are added. The reaction mixture is heated to 140–150° C. with stirring for one hour. The mixture is filtered to provide 985 grams of the desired product which is in the form of a brown oil. The product has a sulfur content of 12.1% by weight, a sodium content of 10.48% by weight, and a boron content of 5.0% by weight.

EXAMPLE O-14

A mixture of 1310 grams (3.36 equivalents) of the product from Example O-8 and 53.4 grams (1.67 equivalents) of sulfur are heated to a temperature of 140–150° C. and maintained at that temperature with stirring for 29.5 hours. The reaction mixture is cooled to 100° C. and filtered using diatomaceous earth to provide 1182 grams of the desired product which is in the form of a brown-black oil. The product has a sulfur content of 12.0% by weight and a sodium content of 17.5% by weight, and a base number (bromophenol blue) of 241. The product has copper strip ratings (ASTM D-130) of 1B–2A (100° C., 3 hours, 1%) and 2A–2B (100° C., 3 hours, 5%).

EXAMPLE O-15

A mixture of 8960 grams (70 equivalents) of the product from Example O-1(a) and 1024 grams (32 equivalents) of sulfur is heated to 140–150° C. with stirring. 2240 grams (70 equivalents) of $SO_2$ are blown through the mixture at a rate of 1.5 cfh over a period of 34 hours. The reaction mixture is blown with nitrogen for one hour at 150° C. and filtered using diatomaceous earth to provide 9330 grams of the desired product which is in the form of a clear brown oil and has a sulfur content of 21.68% by weight, a sodium content of 15.86% by weight and a copper strip rating (ASTM D-130) of 1A (100° C., 3 hours, 5%).

In one embodiment the sulfurized overbased products are contacted with an effective amount of at least one active sulfur reducing agent to reduce the active sulfur content of such products. This can be done in instances wherein the sulfurized overbased products are considered to be too corrosive for the desired application. The term "active sulfur" is used herein to mean sulfur in a form that can cause staining of copper and similar materials. Standard tests such as ASTM D-130 are available for measuring sulfur activity.

The active sulfur reducing agent can be air in combination with activated carbon, steam, one or more of the boron compounds (e.g., boric acid) described above, one or more of the phosphites (e.g., di and tributylphosphite, triphenyl phosphite) described herein, or one or more of the olefins (e.g., $C_{1618}$ α-olefin mixture) described above. In one embodiment, the active sulfur reducing agent is the reaction product of one or more of the above acylated amines or a Group II metal dithiophosphate.

Typically, the weight ratio of the active sulfur reducing agent to the sulfurized overbased product can be up to about 1, but is preferably up to about 0.5. In one embodiment, the active sulfur reducing agent is boric acid and the weight ratio between it and the sulfurized overbased product is from about 0.001 to about 0.1, preferably about 0.005 to about 0.03. In one embodiment, the active sulfur reducing agent is one of the above indicated phosphites, preferably triphenyl phosphite, and the weight ratio of it to the sulfurized overbased product of from about 0.01 to about 0.2. In one embodiment, the active sulfur reducing agent is one of the above discussed olefins and the weight ratio of it to the sulfurized overbased product is from about 0.2 to about 0.7.

Phosphorus Compounds

The lubricating compostions, concentrates, and greases may include a phosphorus compound. The phosphorus compound is selected from the group consisting of a metal dithiophosphate, a phosphoric acid ester or salt thereof, a reaction product of a phosphite and sulfur or a source of sulfur, a phosphite, a reaction product of a phosphorus acid or anhydride and an unsaturated compound, and mizxtures of two or more thereof. Typically, the phosphorus containing antiwear/extreme pressure agent is present in the lubricants and functional fluids at a level from about 0.01% up to about 10%, or from about 0.05% or up to about 4%, or from about 0.08% up to about 3%, or from 0.1% to about 2% by weight.

The metal thiophosphate are prepared by reacting a metal base with one or more thiophosphorus acids. The thiophosphorus acid may be prepared by reacting one or more phosphorus sulfides, which include phosphorus pentasulfide, phosphorus sesquisulfide, phosphorus heptasulfide and the like, with one or more alcohols. The thiophosphorus acid may be mono- or dithiophosphorus acids. The alcohols generally contain from one to about 30, or from two to about 24, or from about 3 to about 12, or from about 3 up to about 8 carbon atoms. Alcohols used to prepare the thiophosphoric acids include propyl, butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography); and Alfol 22+ alcohols ($C_{18}$–$C_{28}$ primary alcohols containing primarily $C_{22}$ alcohols). Alfol alcohols are available from Continental Oil Company. Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha-olefin fraction of $C_{11}$–$C_{14}$, and the latter is derived from a $C_{15}$–$C_{18}$ alpha-olefin fraction.

In one embodiment, the phosphorus acid is a thiophosphoric acid, preferably a monothiophosphoric acid. Thiophosphoric acids may be prepared by the reaction of a sulfur source with a dihydrocarbyl phosphite. The sulfur source may for instance be elemental sulfur, or a sulfide, such as a sulfur coupled olefin or a sulfur coupled dithiophosphate. Elemental sulfur is a preferred sulfur source. The preparation of monothiophosphoric acids are disclosed in U.S. Pat. No. 4,755,311 and PCT Publication WO 87/07638, which are incorporated herein by reference for their disclosure of monothiophosphoric acids, sulfur sources, and the process for making monothiophosphoric acids. Monothiophosphoric acids may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C., or higher) to form the monothiophosphoric acid.

In another embodiment, the phosphorus acid is a dithiophosphoric acid or phosphorodithioic acid. The dithiophosphoric acid may be represented by the formula $(R_4O)_2PSSH$, wherein each $R_4$ is independently a hydrocarbyl group, containing from about 3 to about 30, or from about 3 up to about 18, or from about 4 up to about 12, or up to about 8 carbon atoms. Examples $R_4$ include isopropyl, isobutyl, n-butyl, sec-butyl, amyl, n-hexyl, methylisobutyl carbinyl, heptyl, 2-ethylhexyl, isooctyl, nonyl, behenyl, decyl, dodecyl, tridecyl, alkylphenyl groups, or mixtures thereof. Illustrative lower alkylphenyl $R_4$ groups include butylphenyl, amylphenyl, and heptylphenyl and mixtures thereof. Examples of mixtures of $R_4$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

The metal thiophosphates are prepared by the reaction of a metal base with the thiophosphorus acid. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals, and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper or zinc. Examples of metal compounds which may be reacted with the phosphorus acid include zinc hydroxide, zinc oxide, copper hydroxide, copper oxide, etc.

Examples of metal dithiophosphates include zinc isopropyl, methylamyl dithiophosphate, zinc isopropyl isooctyl dithiophosphate, barium di(nonyl) dithiophosphate, zinc di(cyclohexyl) dithiophosphate, copper di(isobutyl) dithiophosphate, calcium di(hexyl) dithiophosphate, zinc isobutyl isoamyl dithiophosphate, and zinc isopropyl secondary-butyl dithiophosphate.

In one embodiment, the phosphorus compound (B) is a phosphorus acid ester. The ester is prepared by reacting one or more phosphorus acids or anhydrides with an alcohol containing from one to about 30, or from two to about 24, or from about 3 to about 12 carbon atoms. The alcohols used to prepare the phosphorus acid esters include those described above for metal thiophosphates. The phosphorus acid or anhydride is generally an inorganic phosphorus reagent, such as phosphorus pentoxide, phosphorus trioxide, phosphorus tetroxide, phosphorous acid, phosphoric acid, phosphorus halide, $C_{1-7}$ phosphorus esters, or one of the above described phosphorus sulfides. In one embodiment, the phosphorus acid is a thiophosphorus acid or salt thereof. The thiophosphoric acids and their salts are described above. Examples of phosphorus acid esters include phosphoric acid di- and tri-esters prepared by reacting a phosphoric acid or anhydride with cresol alcohols, e.g. tricresylphosphate.

In one embodiment, the phosphorus compound (B) is a phosphorus ester prepared by reacting one or more dithiophosphoric acid with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols, having from 1 to about 12, or from about 2 to about 6, or from about 2 to about 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. No. 3,197,405 and U.S. Pat. No. 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and has an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and has an acid number of 126 (bromophenol blue).

Acidic phosphoric acid esters may be reacted with ammonia, an amine, or metallic base to form an ammonium or metal salt. The salts may be formed separately and then the salt of the phosphorus acid ester may be added to the lubricating composition. Alternatively, the salts may also be formed in situ when the acidic phosphorus acid ester is blended with other components to form a fully formulated lubricating composition. When the phosphorus acid esters are acidic, they may be reacted with ammonia, an amine, or metallic base to form the corresponding ammonium or metal salt. The salts may be formed separately and then the salt of the phosphorus acid ester is added to the lubricating or functional fluid composition. Alternatively, the salts may also be formed when the phosphorus acid ester is blended with other components to form the lubricating or functional fluid composition. The phosphorus acid ester could then form salts with basic materials which are in the lubricating composition or functional fluid composition such as basic nitrogen containing compounds (e.g., acylated amines) and overbased materials.

The ammonium salts of the phosphorus acid esters may be formed from ammonia, or an amine, or mixtures thereof. These amines can be monoamines or polyamines. Useful amines include those disclosed in U.S. Pat. No. 4,234,435 at Col. 21, line 4 to Col. 27, line 50, this section of this reference being incorporated herein by reference.

The monoamines generally have at least one hydrocarbyl group containing from 1 to about 24 carbon atoms, with from 1 to about 12 carbon atoms being preferred, with from 1 to about 6 being more preferred. Examples of monoamines include methylamine, ethylamine, propylamine, butylamine, 2-ethylhexylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In one embodiment, the amine is a fatty ($C_{8-30}$) amine which include n-octylamine, n-decylamine, n-dodecylamine, n-tetradecylamine, n-hexadecylamine, n-octadecylamine, oleylamine, etc. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

Other useful amines include primary ether amines, such as those represented by the formula, $R''(OR')_xNH_2$, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines represented by the formula $R_5—C(R_6)_2—NH_2$, wherein $R_5$ is a hydrocarbyl group containing from one to about 27 carbon atoms and $R_6$ is a hydrocarbyl group containing from 1 to about 12 carbon atoms. Such amines are illustrated by t-butylamine, t-hexylamine, 1-methyl-1-amino-cyclohexane, t-octylamine, t-decylamine, t-dodecylamine, t-tetradecylamine, t-hexadecylamine, t-octadecylamine, t-tetracosanylamine, and t-octacosanylamine.

Mixtures of tertiary aliphatic amines may also be used. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary aliphatic primary amines and methods for their preparation are known to those of ordinary skill in the art. The tertiary aliphatic primary amines are described in U.S. Pat. No. 2,945,749, which is hereby incorporated by reference for its teaching in this regard.

In one embodiment, the amine may be a hydroxyamine. Typically, the hydroxyamines are primary, secondary or tertiary alkanol amines or mixtures thereof. Such amines can be represented by the formulae: $H_2—N—R'—OH$, $H(R'_1)N—R'—OH$, and $(R'_1)_2—N—R'—OH$, wherein each $R'_1$ is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group such as an ethylene, propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with aforedescribed amines and may be represented by the formulae: $H_2N—(R'O)_x—H$ (VIII), $H(R'_1)—N—(R'O)_x—H$ (IX), and $(R'_1)_2—N—(R'O)_x—H$ (X), wherein x is a number from about 2 to about 15 and $R_1$ and R' are as described above. $R'_1$ may also be a hydroxypoly(hydrocarbyloxy) group.

In another embodiment, the amine is a hydroxyamine which may be represented by the formula

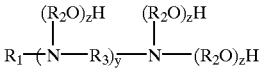

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 up to about 8, or from 1 up to about 5 carbon atoms; y is zero or one; and each z is independently a number from zero to about 10, with the proviso that at least one z is zero.

Useful hydroxyhydrocarbyl amines where y in the above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero in the above formula. These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleylamine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen 0/12 which is the condensation product of one mole of oleyl amine with 2 moles propylene oxide.

The amine may also be a polyamine. The polyamines include alkoxylated diamines, fatty diamines, described above, alkylenepolyamines (described above), hydroxy containing polyamines, condensed polyamines, described above, and heterocyclic polyamines, described above. Commercially available examples of alkoxylated diamines include those amines where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the amine is an alkylenepolyamine. Alkylenepolyamines are represented by the formula $HR_{28}N$- (Alkylene-N)$_n$—$(R_{28})_2$, wherein each $R_{28}$ is independently hydrogen; or an aliphatic or hydroxy-substituted aliphatic group of up to about 30 carbon atoms; $\overline{M}n$ is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, R28 is defined the same as $R'_1$ above. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% tirethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like. These alkylenepolyamine bottoms may be reacted solely with the acylating agent or they may be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1,3-propanediol, N,N,N',N'-tetrakis (2-hydroxypropyl) ethylenediamine, and N,N,N',N'-tetrakis (2-hydroxyethyl) ethylenediamine, preferably tris(hydroxymethyl) aminomethane (THAM).

Polyamines which may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris(hydroxymethyl) aminomethane (THAM).

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The preferred polyoxyalkylene polyamines include the polyoxyethylene and polyoxypropylene diamines and the polyoxypropylene triamines. The polyoxyalkylene polyamines are commercially available and may be obtained, for example, from the Jefferson Chemical Company, Inc. under the trade name "Jeffamines D-230, D-400, D-1000, D-2000, T403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N(diethanol)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxides in a 1.1 to 1.2 molar ratio. Reactant ratios and temperatures for carrying out such reactions are known to those skilled in the art. Specific examples of hydroxy-containing polyamines include N-(2-hydroxyethyl) ethylenediamine, N,N'-bis(2-hydroxyethyl)-ethylenediamine, 1-(2-hydroxyethyl)piperazine, mono (hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above described polyamines are also useful.

In another embodiment, the amine is a heterocyclic amine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen arid/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic amines are also useful. Examples include N-(2-hydroxyethyl)cyclohexylamine, 3-hydroxycyclopentylamine, parahydroxyaniline, N-hydroxyethylpiperazine, and the like.

Hydrazine and hydrocarbyl substituted-hydrazine may also be used to form the acylated nitrogen dispersants. At least one of the nitrogen atoms in the hydrazine must contain a hydrogen directly bonded thereto. Preferably there are at least two hydrogens bonded directly to hydrazine nitrogen and, more preferably, both hydrogens are on the same nitrogen. Specific examples of substituted hydrazines are methylhydrazine, N,N-dimethyl-hydrazine, N,N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methyl-hydrazine, N,N'-di(para-chlorophenol)-hydrazine, N-phenyl-N'-cyclohexylhydrazine, and the like.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, borates, or the like. The metals of the metal base include Group IA, IIA, IB through VIIB, and VIII metals (CAS version of the Periodic Table of the Elements). These metals include the alkali metals, alkaline earth metals, and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper, or zinc. Examples of metal compounds which may be reacted with the phosphorus acid include zinc hydroxide, zinc oxide, copper hydroxide, copper oxide, etc.

In another embodiment, the phosphorus compound (B) is a metal thiophosphate, preferably a metal dithiophosphate. The metal thiophosphates are described above. In another embodiment, the metal dithiophosphates are further reacted with one or more of the above described epoxides, preferably propylene oxide. These reaction products are described in U.S. Pat. Nos. 3,213,020; 3,213,021; and 3,213,022, issued to Hopkins et al. These patents are incorporated by reference for such description of the reaction products.

The following Examples P-3 to P-7 exemplify the preparation of useful phosphorus acid ester salts.

EXAMPLE P-3

A reaction vessel is charged with 217 grams of the filtrate from Example P-1. A commercial aliphatic primary amine (66 grams), having an average product mixture is filtered using a diatomaceous earth. The filtrate has 8.58% zinc and 7.03% phosphorus.

EXAMPLE P-7

Phosphorus pentoxide (208 grams) is added to the product prepared by reacting 280 grams of propylene oxide with 1184 grams of O,O'-diisobutylphosphorodithioic acid at 30–60° C. The addition is made at a temperature of 50–60° C. and the resulting mixture is then heated to 80° C. and held at that temperature for 2 hours. The commercial aliphatic primary amine identified in Example P-3 (384 grams) is added to the mixture, while the temperature is maintained in the range of 30–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, phosphorus compound (B) is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula RCOOH (XII), wherein R is a hydrocarbyl group, preferably free from acetylenic unsaturation. Generally, R contains from about 2 up to about 40, or from about 3 up to about 24, or from about 4 up to about 12 carbon atoms. In one embodiment, R contains from about 4, or from about 6 up to about 12, or up to about 8 carbon atoms. In one embodiment, R is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids, and linoleic dimer acid. A preferred carboxylic acid is 2-ethylhexanoic acid.

The metal salts may be prepared by merely blending a metal salt of a dithiophosphoric acid with a metal salt of a carboxylic acid in the desired ratio.

The ratio of equivalents of dithiophosphoric acid to carboxylic acid is from about 0.5 up to about 400 to 1. The ratio may be from 0.5 up to about 200, or up to molecular weight of 191 in which the aliphatic radical is a mixture of tertiary alkyl radicals containing from 11 to 14 carbon atoms, is added over a period of 20 minutes at 25–60° C. The resulting product has a phosphorus content of 10.2% by weight, a nitrogen content of 1.5% by weight, and an acid number of 26.3.

EXAMPLE P-4

The filtrate of Example P-2 (1752 grams) is mixed at 25–82° C. with 764 grams of the aliphatic primary amine used in of Example P-3. The resulting product has 9.95% phosphorus, 2.72% nitrogen, and 12.6% sulfur.

EXAMPLE P-5

Alfol 8–10 (2628 parts, 18 moles) is heated to a temperature of about 45° C. whereupon 852 parts (6 moles) of phosphorus pentoxide are added over a period of 45 minutes while maintaining the reaction temperature between about 45–65° C. The mixture is stirred an additional 0.5 hour at this temperature, and is there-after heated at 70° C. for about 2–3 hours. Primene 81-R (2362 parts, 12.6 moles) is added dropwise to the reaction mixture while maintaining the temperature between about 30–50° C. When all of the amine has been added, the reaction mixture is filtered through a filter aid, and the filtrate is the desired amine salt containing 7.4% phosphorus (theory, 7.1%).

EXAMPLE P-6

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60–70° C. under a pressure of 30 mm Hg. The resulting about 100, or up to about 50, or up to about 20 to 1. In one embodiment, the ratio is from 0.5 up to about 4.5 to 1, or from about 2.5 up to about 4.25 to 1. For this purpose, the equivalent weight of a dithiophosphoric acid is its molecular weight divided by the number of -PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

In another embodiment, the phosphorus compound (B) may be a phosphite. In one embodiment, the phosphite is a di- or trihydrocarbyl phosphite. Preferably each hydrocarbyl group has from 1 to about 24 carbon atoms, more preferably from 1 to about 18 carbon atoms, and more preferably from about 2 to about 8 carbon atoms. Each hydrocarbyl group may be independently alkyl, alkenyl, aryl, and mixtures thereof. When the hydrocarbyl group is an aryl group, then it contains at least about 6 carbon atoms; preferably about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, more preferably butyl, oleyl or phenyl and more preferably butyl, oleyl, or phenyl. Phosphites and their preparation are known and many phosphites are available commercially. Particularly useful phosphites are dibutyl hydrogen phosphite, dioleyl hydrogen phosphite, di($C_{14-18}$) hydrogen phsophite, and triphenyl phosphite.

In one embodiment, the phosphorus compound (B) may be a reaction product of a phosphorus acid and an unsaturated compound. The unsaturated compounds include unsaturated amides, esters, acids, anhydrides, and ethers. The phosphorus acids are described above, preferably the phosphorus acid is a dithiophosphoric acid.

In one embodiment, the unsaturated compound is an unsaturated amide. Examples of unsaturated amides include acrylamide, N,N'-methylene bisacrylamide, methacrylamide, crotonamide, and the like. The reaction product of the phosphorus acid with the unsaturated amide may be further reacted with linking or coupling compounds, such as formaldehyde or paraformaldehyde, to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the unsaturated compound an unsaturated carboxylic acid or ester, such as a vinyl or allyl acid or ester. If the carboxylic acid is used, the ester may then be formed by subsequent reaction with an alcohol. In one embodiment, the unsaturated carboxylic acids include the unsaturated fatty acids and esters described above. The vinyl ester of a carboxylic acid may be represented by the formula $RCH{=}CH{-}O(O)CR^1$, wherein R is a hydrogen or hydrocarbyl group having from 1 to about 30 carbon atoms, preferably hydrogen or a hydrocarbyl group having 1 to about 12, more preferably hydrogen, and $R^1$ is a hydrocarbyl group having 1 to about 30 carbon atoms, preferably 1 to about 12, more preferably 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula $RO{-}(O)C{-}HC{=}CH{-}C(O)OR$, wherein each R is independently a hydrocarbyl group having 1 to about 18 carbon atoms, preferably 1 to about 12, more preferably 1 to about 8 carbon atoms. Examples of unsaturated carboxylic esters, useful in the present invention, include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus compound is the reaction product of a phosphorus acid and a vinyl ether. The vinyl ether is represented by the formula $R{-}CH_2{=}CH{-}OR^1$, wherein R is hydrogen or a hydrocarbyl group having 1 to about 30, preferably 1 to about 24, more preferably 1 to about 12 carbon atoms, and $R^1$ is a hydrocarbyl group having 1 to about 30 carbon atoms, preferably 1 to about 24, more preferably 1 to about 12 carbon atoms. Examples of vinyl ethers include vinyl methylether, vinyl propylether, vinyl 2-ethylhexylether and the like.

Boron-Containing Antiwear/Extreme Pressure Agents

The lubricants and/or functional fluids may additionally contain a boron compound. Typically, the boron containing antiwear/extreme pressure agent is present in the lubricants and functional fluids at a level from about 0.01% up to about 10%, or from about 0.05% or up to about 4%, or from about 0.08% up to about 3%, or from 0.1% to about 2% by weight. Examples of boron containing antiwear/extreme pressure agents include a borated dispersant; an alkali metal or a mixed alkali metal, alkaline earth metal borate; a borated overbased metal salt; a borated epoxide; and a borate ester. The borated overbased metal salts are described above.

In one embodiment, the boron compound is a borated dispersant. Borated dispersant are prepared by reaction of one or more dispersant with one or more boron compounds. The dispersants include acylated amines, carboxylic esters, Mannich reaction products, hydrocarbyl substituted amines, and mixtures thereof. The acylated amines include reaction products of one or more of the above carboxylic acylating agents and one or more amine. The amines may be any of those described above, preferably a polyamine, such as an alkylenepolyamine or a condensed polyamine.

Acylated amines and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents is hereby incorporated by reference.

In another embodiment, the dispersant may also be a carboxylic ester. The carboxylic ester is prepared by reacting at least one or more of the above carboxylic acylating agents, preferrably a hydrocarbyl substituted carboxylic acylating agent, with at least one organic hydroxy compound and optionally an amine. In another embodiment, the carboxylic ester dispersant is prepared by reacting the acylating agent with at least one of the above-described hydroxyamines.

The organic hydroxy compound includes compounds of the general formula $R''(OH)_m$ wherein R" is a monovalent or polyvalent organic group joined to the —OH groups through a carbon bond, and m is an integer from 1 to about 10 wherein the bydrocarbyl group contains at least about 8 aliphatic carbon atoms. The hydroxy compounds may be aliphatic compounds, such as monohydric and polyhydric alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived generally contain up to about 40 carbon atoms, or from 2 to about 30, or from 2 to about 10. They may be monohydric alcohols, such as methanol, ethanol, isooctanol, dodecanol, cyclohexanol, etc. The hydroxy compounds may also be polyhydric alcohols, such as alkylene polyols. In one embodiment, the polyhydric alcohols contain from 2 to about 40 carbon atoms, from 2 to about 20; and from 2 to about 10 hydroxyl groups, or from 2 to about 6. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; trimethylolpropane; sucrose; fructose; glucose; cyclohexanediol; erythritol; and pentaerythritols, including di- and tripentaerythritol.

The polyhydric alcohols may be esterified with monocarboxylic acids having from 2 to about 30, or from about 8 to about 18 carbon atoms, provided that at least one hydroxyl group remains unesterified. Examples of monocarboxylic acids include acetic, propionic, butyric and above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of the carboxylic acylating agents described above with one or more alcohol or phenol in ratios from about 0.5 equivalent to about 4 equivalents of hydroxy compound per equivalent of acylating agent. The esterification is usually carried out at temperatures above about 100° C., or between 150° C. and 300° C. The water formed as a by-product is removed by distillation as the esterification proceeds. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines, such as a polyethylenepolyamine or a heterocyclic amine, such as aminopropylmopholine. The amine is added in an amount sufficient to neutralize any nonesterified carboxyl groups. In one embodiment, the carboxylic ester dispersants are prepared by reacting from about 1 to about 2 equivalents, or from about 1.0 to 1.8 equivalents of hydroxy compounds, and up to about 0.3 equivalent, or from about 0.02 to about 0.25 equivalent of polyamine per equivalent of acylating agent. The carboxylic acid acylating agent may be reacted simultaneously with both the hydroxy compound and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester dispersant compositions are known in the art, and the preparation of a number of these derivatives is described in, for example, U.S. Pat. Nos. 3,957,854 and 4,234,435 which have been incorporated by reference previously.

In another embodiment, the dispersant may also be a hydrocarbyl-substituted amine. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same. Typically, hydrocarbyl substituted amines are prepared by reacting olefins and olefin polymers, including the above polyalkenes and halogenated derivatives thereof, with amines (mono- or polyamines). The amines may be any of the amines described above, preferrably an alkylenepolyamine. Examples of hydrocarbyl substituted amines include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene)ethylenediamine; N-poly(propylene) trimethylenediamine; N-poly(butene)diethylenetriamine; N',N'-poly(butene)tetraethylenepentamine; N,N-dimethyl-N'-poly(propylene)-1,3-propylenediamine and the like.

In another embodiment, the dispersant may also be a Mannich dispersant. Mannich dispersants are generally formed by the reaction of at least one aldehyde, such as formaldehyde and paraformaldehyde, at least one of the above described amines and at least one alkyl substituted hydroxyaromatic compound. The reaction may occur from room temperature to about 225° C., or from about 50° to about 200° C., or from about 75° C. to about 150° C. The amounts of the reagents is such that the molar ratio of hydroxyaromatic compound to formaldehyde to amine is in the range from about (1:1:1) to about (1:3:3).

The first reagent is an alkyl substituted hydroxyaromatic compound. This term includes the above described phenols. The hydroxyaromatic compounds are those substituted with at least one, and preferably not more than two, aliphatic or alicyclic groups having from about 6 up to about 400, or from about 30 up to about 300, or from about 50 up to about 200 carbon atoms. These groups may be derived from one or more of the above described olefins or polyalkenes. In one embodiment, the hydroxyaromatic compound is a phenol substituted with an aliphatic or alicyclic hydrocarbon-based group having an $\overline{M}n$ of about 420 to about 10,000.

The third reagent is any amine described above containing at lest one NH group. Preferably the amine is one or more of the above described polyamines, such as the polyalkylenepolyamines. Mannnich dispersants are described in the following patents: U.S. Pat. No. 3,980,569; U.S. Pat. No. 3,877,899; and U.S. Pat. No. 4,454,059 (herein incorporated by reference for their disclosure to Mannich dispersants).

In another embodiment, the dispersant is a borated dispersant. The borated dispersants are prepared by reacting one or more of the above disperants with one or more of the above described one boron compounds.

Typically, the borated dispersant contains from about 0.1% up to about 5%, or from about 0.5% up to about 4%, or from 0.7% up to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. These references are incorporated by reference for their disclosure of borated dispersants.

The following examples relate to dispersants useful in the present invention.

EXAMPLE B-1

(a) An acylated nitrogen composition is prepared by reacting 3880 grams of the polyisobutenyl succinic anhydride, 376 grams of a mixture of triethylenetetramine and diethylene triamine (75:25 weight ratio), and 2785 grams of mineral oil in toluene at 150° C. The product is vacuum stripped to remove toluene.

(b) A mixture of 62 grams (1 atomic proportion of boron) of boric acid and 1645 grams (2.35 atomic proportions of nitrogen) of the acylated nitrogen composition obtained from B-1(a) is heated at 150° C. in nitrogen atmosphere for 6 hours. The mixture is then filtered and the filtrate is found to have a nitrogen content of 1.94% and a boron content of 0.33%.

EXAMPLE B-2

A mixture of 372 grams (6 atomic proportions of boron) of boric acid and 3111 grams (6 atomic proportions of nitrogen) of a acylated nitrogen composition, obtained by reacting 1 equivalent of a polybutenyl ($\overline{M}n$=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours and then filtered. The filtrate is found to have a boron content of 1.64% and a nitrogen content of 2.56%.

EXAMPLE B-3

Boric acid (124 grams, 2 atomic proportions of boron) is added to the acylated nitrogen composition (556 grams, 1 atomic proportion of nitrogen) of Example B-2. The resulting mixture is heated at 150° C. for 3.5 hours and filtered at that temperature. The filtrate is found to have a boron compound of 3.23% and a nitrogen content of 2.3%.

EXAMPLE B-4

(a) A reaction vessel is charged with 1000 parts of a polybutenyl ($\overline{M}n$=1000 substituted succinic anhydride having a total acid number of 108 with a mixture of 275 grams of oil and 139 parts of a commercial mixture of polyamines corresponding to 85% E-100 amine bottoms and 15% diethylenetriamine. The reaction mixture is heated to 150 to 160° C. and held for four hours. The reaction is blown with nitrogen to remove water.

(b) A reaction vessel is charged with 1405 parts of the product of Example B-4(a), 229 parts of boric acid, and 398 parts of diluent oil. The mixture is heated to 100 to 150° C. and the temperature maintained until water is removed. The final product contains 2.3% nitrogen, 1.9% boron, 33% 100 neutral mineral oil and a total base number of 60.

In one embodiment, the boron compound is an alkali or an alkali metal and alkaline earth metal borate. These metal borates are generally a hydrated particulate metal borate which are known in the art. Alkali metal borates include mixed alkali and alkaline metal borates. These metal borates are available commercially. Representative patents disclosing suitable alkali and alkali metal and alkaline earth metal borates and their methods of manufacture include U.S. Pat. Nos. 3,997,454; 3,819,521; 3,853,772; 3,907,601; 3,997,454; and 4,089,790. These patents are incorporated by reference for their disclosures of the metal borates and methods of their manufacture.

In another embodiment, the boron compound is a borated fatty amine. The borated amines are prepared by reacting one or more of the above boron compounds with one or more of the above fatty amines, e.g., an amine having from about four up to about eighteen carbon atoms. The borated fatty amines are prepared by reacting the amine with the boron compound from about 50° C. to about 300° C., preferably from about 100° C. to about 250° C., and at a ratio from about 3:1 to about 1:3 equivalents of amine to equivalents of boron compound.

In another embodiment, the boron compound is a borated epoxide. The borated fatty epoxides are generally the reaction product of one or more of the above boron compounds with at least one epoxide. The epoxide is generally an aliphatic epoxide having from 8 up to about 30, preferably from about 10 up to about 24, more preferably from about 12 up to about 20 carbon atoms. Examples of useful aliphatic epoxides include heptyl epoxide, octyl epoxide, oleyl epoxide and the like. Mixtures of epoxides may also be used, for instance commercial mixtures of epoxides having from about 14 to about 16 carbon atoms and from about 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In one embodiment, the boron compound is a borate ester. The borate esters may be prepared by reacting of one or more of the above boron compounds with one or more of the above alcohols. Typically, the alcohols contain from about 6 up to about 30, or from about 8 to about 24 carbon atoms. The methods of making such borate esters are known to those in the art.

In another embodiment, borate ester is a borated phospholipid. The borated phospholipids are prepared by reacting a combination of a phospholipid and a boron compound, Optionally, the combination may include an amine, an acylated nitrogen compound, a carboxylic ester, a Mannich reaction product, or a neutral or basic metal salt of an organic acid compound. These additional components are described above. Phospholipids, sometimes referred to as phosphatides and phospholipins, may be natural or synthetic. Naturally derived phospholipids include those derived from fish, fish oil, shellfish, bovine brain, chicken egg, sunflowers, soybean, corn, and cottonseeds. Phospholipids may be derived from microorganisms, including blue-green algae, green algae, and bacteria.

The reaction of the phospliolipid and the boron compound usually occurs at a temperature from about 60° C. up to about 200° C., or from about 90° C., or up to about 150° C. The reaction is typically accomplished in about 0.5 up to about 10 hours. The boron compound and phospholipid are reacted at an equivalent ratio of boron to phosphorus of 1–6:1 or 2–4:1, or 3:1. When the combination includes additional components (e.g. amines, acylated amines, neutral or basic meal salts, etc.), the boron compound is reacted with the mixture of the phospholipid and one or more optional ingredients in an amount of one equivalent of boron to an equivalent of the mixture of a phospholipid and an optional ingredient in a ratio from about one, or about two up to about six, to about four to one. The equivalents of the mixture are based on the combined equivalents of phospholipid based on phosphorus and equivalents of the optional ingredients.

Lubricants

As previously indicated, the combination of a organic polysulfide and an overbased composition, a phosphorus or boron compound, or mixture thereof are useful as additives for lubricants in which they can function primarily as antiwear, antiweld, and/or extreme pressure agents. Lubricants containing this combination have improved properties such as those relating to odor, copper strip, thermal stability wear, scuffing, oxidation, surface fatigue, seal compatibility, corrosion resistance, and thermal durability. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, and rail and flange lubricants.

As described above, the lubricating composition contains an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydrotreated mineral oil or a synthetic lubricating oil, such a polyolefin. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity is a polyalpha-olefin (PAO). Typically, the polyalpha-olefins are derived from monomers having from about 3 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol 3174 available from The Lubrizol Corporation.

In one embodiment, the oil of lubricating viscosity includes at least one ester of a dicarboxylic acid. Typically the esters containing from about 4 to about 30, preferably from about 6 to about 24, or from about 7 to about 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

Additional Additives

In one embodiment, the lubricating compositions and functional fluids contain one or more auxiliary extreme pressure and/or antiwear agents, corrosion inhibitors and/or oxidation inhibitors. Auxiliary extreme pressure agents and corrosion and oxidation inhibiting agents which may be included in the lubricants and functional fluids of the invention are exemplified by halogenated, e.g. chlorinated, aliphatic hydrocarbons such as chlorinated olefins or waxes; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters (e.g. the reaction product of dibutylamine, carbon disulfide, and methyl acrylate); dithiocarbamate containing amides, prepared from dithiocarbamic acid and an acrylamide (e.g. the reaction product of dibutylamine, carbon disulfide, and acrylamide); alkylene-coupled dithiocarbamates (e.g. methylene or phenylene bis(dibutyldithiocarbamate); sulfur-coupled dithiocarbamates (e.g. bis(S-alkyldithiocarbamoyl) disulfides). Many of the above-mentioned auxiliary extreme pressure agents and corrosion-oxidation inhibitors also serve as antiwear agents.

The lubricating compositions and functional fluids may contain one or more pour point depressants, color stabilizers, metal deactivators and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

These additional additives, when used, are present in the inventive lubricating and functional fluid compositions at sufficient concentrations to provide the compositions with enhanced properties depending upon their intended use. For example, the detergents are added at sufficient concentrations to provide the inventive compositions with enhanced detergency characteristics, while the antifoam agents are added at sufficient concentrations to provide the inventive compositions with enhanced antifoaming characteristics. Generally, each of these additional additives are present in the lubricants and functional fluids at concentrations from about 0.01%, or from about 0.05%, or from about 0.5%. These additional additives are generally present in an amount up to about 20% by weight, or up to about 10% by weight, and or up to about 3% by weight.

In one embodiment, the lubricating compositons contain less than 2%, or less than 1.5%, or less than 1% by weight of a dispersant. In another embodiment, the lubricating compositions are free of lead based additives, metal (zinc) dithiophosphates, and alkali or alkaline earth metal borates.

In another embodiment, the combination of the organic polysulfide and the overbased composition or the phosphorus or boron compound, or mixtures thereof may be used in concentrates. The concentrate may contain the above combination alone or with other components used in preparing fully formulated lubricants. The concentrate also contains at least one substantially inert organic diluent, which includes kerosene, mineral distillates, or one or more of the oils of lubricating viscosity discussed above. In one embodiment, the concentrates contain from 0.01% up to about 49.9%, or from about 0.1% up to about 45% by weight of the organic diluent.

The following Examples relates to lubricants of the present invention

EXAMPLE I

A gear lubricant is prepared by incorporating 3.5% of the product of Example S-1, and 1.3% of the product of example P-3 into a SAE 90 lubricating oil mixture.

EXAMPLE II

A lubricant is prepared as described in Example I, except the lubricant additionally contains 0.9% of product of Example O-2b.

EXAMPLE III

A gear lubricant is prepared by incorporating 4% of the product of Example S-1 and 1.3% of di($C_{1418}$) hydrogen phosphite into a SAE 80W-90 lubricating oil mixture.

EXAMPLE IV

A gear lubricant is prepared by incorporating 3.3% of the product of Example S-2, 1.2% of the product of Example O-2b into an SAE 80W-90 lubricating oil mixture.

EXAMPLE V

A gear lubricant is prepared as described in Example IV where the lubricant additionally contains 1.2% of the product of Example P-3.

EXAMPLE VI

A gear lubricant is prepared by incorporating 3.5% of the product of Example S-2, 1.3% of the product of Example P-3, and 0.3% of triphenyl phosphite into an SAE 90 lubricating oil mixture.

EXAMPLE VII

A lubricant is prepared as described in Example VI except the lubricant additionally contains 1.2% of the product of Example O-2b.

EXAMPLE VIII

A lubricant is prepared as described in Example VI except 0.75% of the product of Example P-5 and 0.35% of dibutyl hydrogen phosphite is used in place of the the product of Example P-3.

EXAMPLE IX

A lubricant is prepared as described in Example VI, except the lubricant includes 0.9% of the product of Example B-4.

EXAMPLE X

A gear lubricant is prepared by incorporating 3.5% of the product of Example S-2, and 0.4% of the reaction product of a $C_{16}$ epoxide and boric acid into an SAE 90 lubricating oil mixture.

Greases

Where the lubricant is to be used in the form of a grease, the lubricating oil generally is employed in an amount sufficient to balance the total grease composition and, generally, the grease compositions will contain various quantities of thickeners and other additive components to provide desirable properties. The organic poylsuflide is generallly present in an amount from about 0.1% up to about 10%, or from about 0.5% up to about 5% by weight. The overbased composition or the phosphorus or boron compound is generally present in an amount from about 0.1% up to about 8%, or from about 0.5% up to about 6% by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, oleic acid, palmitic acid, myristic acid, cottonseed oil acids, and hydrogenated fish oil acids.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners. Useful thickeners include hydrophilic clays which are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like.

EXAMPLE G-1

A grease is prepared by incorporating 3% by weight of the product of Example S-1(b) and 0.9% of the product of Example P-3 into a lithium grease, Southwest Petro Chem Lithium 12 OH Base Grease.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of preparing a lubricating oil composition, comprising:

(1) preparing an intermediate product by reacting isobutylene, or a dimer, trimer or tetramer of isobutylene, or a mixture thereof, with sulfur and hydrogen sulfide;

(2) fractionating the intermediate product from step (1) at a subatmospheric pressure in the range of about 1 to about 250 mmHg and a reflux ratio in the range of about 1:1 to about 15:1 to provide a dihydrocarbyl polysulfide mixture comprising at least about 90% dihydrocarbyl trisulfide, from about 0.1 to about 8% dihydrocarbyl disulfide, and less than about 5% dihydrocarbyl higher polysulfides; and (3) blending a mixture comprising a major amount of an oil of lubricating viscosity, (A) the product from step (2), and (B) at least one overbased metal composition or a phosphorus or boron compound, or mixtures thereof.

2. The method of claim 1 wherein the polysulfide mixture contains from about 0.1% up to about 5% dihydrocarbyl disulfide, at least about 93% dihydrocarbyl trisulfide and less than about 4% dihydrocarbyl higher polysulfides.

3. The method of claim 1 wherein (B) is a sodium, calcium, or magnesium sulfonate, carboxylate, or phenate.

4. The method of claim 1 wherein (B) is a borated overbased metal composition or a sulfurized overbased metal composition.

5. The method of claim 1 wherein (B) is a prepared by reacting an overbased metal salt of an acidic organic compound with a boron compound.

6. The method of claim 1 wherein (B) is prepared by reacting an overbased metal salt of an acidic organic compound with a sulfurous acid or source thereof to form an intermediate, and then further reacting the intermediate with sulfur or a source of sulfur.

7. The method of claim 1 wherein (B) is selected from the group consisting of a metal dithiophosphate, a phosphoric acid ester or salt thereof, a reaction product of a phosphite and sulfur or a source of sulfur, a phosphite, a reaction product of a phosphorus acid or anhydride and an unsaturated compound, a borated dispersant, an alkali metal or a mixed alkali metal, alkaline earth metal borate, an overbased compound, and a borate ester.

8. The method of claim 1 wherein (B) is a phosphoric acid ester prepared by reacting a dithiophosphoric acid with an epoxide to form an intermediate, and the intermediate is further reacted with a phosphorus acid or anhydride, or a salt of the phosphoric acid ester.

9. The method of claim 8 wherein (B) is a salt prepared by reacting the phosphoric acid ester with ammonia or an amine.

10. The method of claim 9 wherein the amine is a tertiary aliphatic primary amine.

11. The method of claim 1 wherein (B) is a phosphoric acid ester prepared by reacting a phosphorus acid or anhydride with at least one alcohol containing from one to about 30 carbon atoms, or salt of the phosphoric acid ester.

12. The method of claim 11 wherein (B) is a salt prepared by reacting the phosphoric acid ester with ammonia or an amine.

13. The method of claim 12 wherein the amine is a tertiary aliphatic primary amine.

14. The method of claim 1 wherein the phosphorus compound is a hydrocarbyl phosphite independently having from one to about eighteen carbon atoms in each hydrocarbyl group.

15. The method of claim 1 wherein the phosphorus compound is a phosphorus-containing carboxylic amide, acid, ester, or ether prepared by reacting a phosphorus acid with an unsaturated compound.

16. The method of claim 15 wherein the phosphorus acid is a dithiophosphoric acid.

17. The method of claim 1 wherein (B) is a metal salt of a mixture of (a) at least one dithiophosphoric acid and (b) at least one aliphatic or alicyclic carboxylic acid.

18. The method of claim 1 wherein (B) is a thiophosphate or a reaction product of a phosphite and sulfur or a source of sulfur.

19. The method of claim 1 wherein the composition contains up to about 2% by weight of a dispersant.

20. The method of claim 1 wherein (A) is present in an amount from about 0.1% up to about 10% by weight and (B) is present in an amount from about 0.1% up to about 10% by weight.

21. The method of claim 1 wherein the composition is a gear oil.

22. A method of lubricating a differential comprising the steps of introducing to a differential a lubricating composition made by the method of claim 1.

23. A grease composition comprising at least one thickening agent and a lubricating oil composition made by the method of claim 1.

24. A method of preparing a lubricating oil composition, comprising:

(1) preparing an intermediate product by reacting isobutylene, or a dimer, trimer or tetramer of isobutylene, or a mixture thereof, with sulfur and hydrogen sulfide;

(2) fractionating the intermediate product from step (1) at a subatmospheric pressure in the range of about 1 to about 250 mmHg and a reflux ratio in the range of about 1:1 to about 15:1 to provide a dihydrocarbyl polysulfide mixture comprising at least about 90% dihydrocarbyl trisulfide, from about 0.1 to about 8% dihydrocarbyl disulfide, and less than about 5% dihydrocarbyl higher polysulfides; and (3) blending a major amount of an oil of lubricating viscosity, (A) from about 2% up to about 8% by weight of the polysulfide mixture from step (2), and (B) from about 0.1% up to about 8% by weight of at least one compound selected from the group consisting of an overbased composition, a phosphoric acid ester or salt thereof, a phosphite, a reaction product of a phosphite and sulfur or a source of sulfur, and a borated dispersant.

25. The method of claim 24 wherein (B) is a borated overbased metal composition or a sulfurized overbased composition.

26. The method of claim 24 wherein (B) is a phosphoric acid ester prepared by reacting a dithiophosphoric acid with an epoxide to form an intermediate, and the intermediate is further reacted with a phosphorus acid or anhydride, or a salt of the phosphoric acid ester.

27. The method of claim 24 wherein the phosphoric acid ester is prepared by reacting a phosphorus acid or anhydride with at least one alcohol containing from one to about 30 carbon atoms, or salt thereof.

28. The method of claim 24 wherein the phosphorus compound is a hydrocarbyl phosphite independently having from one to about eighteen carbon atoms in each hydrocarbyl group.

29. The method of claim 24 wherein the phosphorus compound is a hydrocarbyl phosphite independently having from about one to about eight carbon atoms in each hydrocarbyl group.

30. A method of preparing a concentrate, comprising:

(1) preparing an intermediate product by reacting isobutylene, or a dimer, trimer or tetramer of isobutylene, or a mixture thereof, with sulfur and hydrogen sulfide;

(2) fractionating the intermediate product from step (1) at a subatmospheric pressure in the range of about 1 to about 250 mmHg and a reflux ratio in the range of about 1:1 to about 15:1 to provide a dihydrocarbyl polysulfide mixture comprising at least about 90% dihydrocarbyl trisulfide, from about 0.1 to about 8% dihydrocarbyl disulfide, and less than about 5% dihydrocarbyl higher polysulfides; and (3) blending a mixture comprising from 0.01% to about 49.9% by weight of a substantially inert organic diluent, (A) the dihydrocarbyl polysulfide mixture from step (2), and (B) at least one overbased metal composition or a phosphorus or boron compound.

* * * * *